US012617507B1

(12) United States Patent
Deboer et al.

(10) Patent No.: US 12,617,507 B1
(45) Date of Patent: May 5, 2026

(54) BOAT LIFT

(71) Applicant: SBL MANUFACTURING, LLC, Camdenton, MO (US)

(72) Inventors: Joshua David Deboer, Gretna, NE (US); Chase Alan Zacharias, Omaha, NE (US); Mike Vaughn, Afton, OK (US); Ron Witt, Camdenton, MO (US)

(73) Assignee: SBL Manufacturing, LLC, Camdenton, MO (US)

( * ) Notice: Subject to any disclaimer, the term of this patent is extended or adjusted under 35 U.S.C. 154(b) by 184 days.

(21) Appl. No.: 18/528,052

(22) Filed: Dec. 4, 2023

Related U.S. Application Data

(60) Provisional application No. 63/429,638, filed on Dec. 2, 2022.

(51) Int. Cl.
*B63C 1/02* (2006.01)
*B63C 3/06* (2006.01)

(52) U.S. Cl.
CPC . *B63C 1/02* (2013.01); *B63C 3/06* (2013.01)

(58) Field of Classification Search
CPC ..... B63C 1/02; B63C 1/06; B63C 3/06
USPC ..... 405/3; 114/45, 48
See application file for complete search history.

(56) References Cited

U.S. PATENT DOCUMENTS 3,857,248 A * 12/1974 Rutter ..... B63C 3/06 114/45
4,018,179 A * 4/1977 Rutter ..... B63C 1/06 114/45
4,072,119 A * 2/1978 Williams ..... B63C 3/06 114/45
4,808,028 A * 2/1989 White ..... B63C 3/06 114/45
5,131,784 A * 7/1992 Maasen ..... B63B 35/40 403/312
6,752,096 B2 * 6/2004 Elson ..... B29C 41/20 114/45
7,325,503 B1 * 2/2008 Vaughn ..... B63C 1/02 114/45
8,191,911 B1 * 6/2012 Reynolds ..... B60G 3/20 280/124.13
11,027,800 B1 * 6/2021 Jopling ..... B63C 1/02
12,305,347 B1 * 5/2025 Way ..... B63C 3/06
12,319,392 B2 * 6/2025 Maasen ..... B63C 1/06
(Continued)

OTHER PUBLICATIONS

1 Duratek HD Series boat lift, offered for sale prior to Jan. 4, 2023 (3 pgs).

*Primary Examiner* — Frederick L Lagman
(74) *Attorney, Agent, or Firm* — Stinson LLP

(57) ABSTRACT

A boat lift with at least one tank or tube configured to receive air and a bunk support frame coupled to the tube. A torque bar is supported by the bunk support frame and operable to rotate with respect to the frame. A pair of arms are mounted to opposite ends of the torque bar. The bunk support frame may define a channel accessible through first and second openings at ends of the frame with the torque bar extending through the channel. The arms may each include a first end mounted to the torque bar and an adjustable second end for mounting to the dock. A bunk assembly may mount a bunk to the bunk support frame. The bunk assembly including a pair of sections joined with a tab and slot on one side and fasteners on another side. A clamp assembly may mount a tank frame to the tank.

17 Claims, 27 Drawing Sheets

(56) References Cited

U.S. PATENT DOCUMENTS

| | | | | |
|---|---|---|---|---|
| 2008/0008528 | A1* | 1/2008 | Hey | B66F 7/0641 405/3 |
| 2016/0016648 | A1* | 1/2016 | Siokos | B66F 7/0641 114/45 |
| 2023/0331359 | A1* | 10/2023 | Maasen | B63C 3/06 |

* cited by examiner

BOAT LIFT

CROSS-REFERENCE TO RELATED APPLICATIONS

This application is based on and claims priority to U.S. Provisional Application Ser. No. 63/429,638, filed on Dec. 2, 2022, which is incorporated herein by reference in its entirety.

BACKGROUND

A boat lift is often used to suspend a boat above the water when the boat is not in use. Storing a boat above the water on a boat lift is generally more advantageous than storing a boat in the water moored to a dock. When a boat is left in the water, it may be damaged by impacting the dock due to waves and wind moving the boat relative to the dock. Further, water scale and algae can build up on the hull of a boat that is left in the water.

There are many types of boat lifts used to store boats above water. Floating boat lifts are one type of boat lift that are often used in lakes with fluctuating water levels. A floating boat lift typically includes a plurality of tubes that receive air to float the lift and raise a boat supported by the lift above the water. As air is released from the tubes, they fill with water to sink the tubes and lower a boat into the water. A bunk support mounted to the tubes supports a bunk that is configured to engage the hull of a boat above the tubes. Arms are pivotably mounted at one end to the bunk support and at another end to a dock. For example, two arms may be mounted to one side of a dock adjacent a boat slip and two arms may be mounted to the other side of the dock. Conventional floating boat lifts may have many different parts that need to be connected together with fasteners to assemble the lifts and mount them to a dock. Further, conventional floating boat lifts may be configured so that they are only mountable to a dock with a boat slip of a certain width or a limited range of widths. It also may be relatively difficult to adjust or modify the width of a conventional floating boat lift.

BRIEF SUMMARY

The invention described herein is directed to a boat lift having at least one tank or tube configured to receive air and a bunk support frame coupled to the tube. A torque bar is supported by the bunk support frame and operable to rotate with respect to the bunk support frame. A pair of arms are mounted to opposite ends of the torque bar. The arms are configured for mounting to a dock. A bunk coupled to the bunk support frame is configured to support a boat.

In one aspect of the invention, the bunk support frame defines a channel accessible through a first opening at one end of the bunk support frame and a second opening at an opposite end of the bunk support frame. A torque bar extends through the channel from the first opening to the second opening. The bunk support frame may include first and second support bushings that are at least partially received by the first and second openings, respectively. The torque bar extending through and supported by the first and second support bushings.

In another aspect of the invention, each of the arms includes a first end mounted to the torque bar and a second end configured for mounting to a dock. The second end of at least one of the arms is adjustable with respect to the first end in a direction that is generally aligned with a longitudinal axis of the torque bar. Each of the arms may have a first section and a second section that is adjustably coupled to the first section. The first section is mounted to one of the ends of the torque bar, and the second section is configured for mounting to the dock. The second section is adjustably coupled to the first section so that the second end is adjustable in the direction that is aligned with a longitudinal axis of the torque bar. The second section may define a slot positioned between the first end and the second end with a fastener extending through the slot and at least one opening of the first section.

In some embodiments, the torque bar has end surfaces at opposite ends of the torque bar. Each end surface defines at least one threaded opening. Each of the arms is mounted to the torque bar with at least one fastener that extends through an opening in the arm and engages the threaded opening of one of the end surfaces. Each of the arms defines a receptacle that receives one of the ends of the torque bar.

Another aspect of the invention described herein is directed to a boat lift including at least one tank configured to receive air, a bunk support frame coupled to the tank, and a bunk assembly. The bunk assembly includes a support coupled to the bunk support frame and a bunk coupled to the support and configured to support a boat. The support includes a first section and a second section operable to removably couple to the first section to mount the support to the bunk support frame. A first side of the first section has a tab that is receivable within a slot of a first side of the second section. A second side of the first section has a first opening that aligns with a second opening in a second side of the second section when the support is mounted to the bunk support frame. The aligned first and second openings are configured for receiving a fastener to join the first section to the second section.

Another aspect of the invention described herein is directed to a boat lift including at least one tank configured to receive air. The tank including an upper surface, a side wall extending downward from the upper surface, and a clamping surface extending from the side wall. The upper surface defines a pocket, and the side wall defines a slot accessible from the pocket. A tank frame is positioned adjacent the upper surface of the tank. A clamp assembly has a first section configured for insertion into the slot and the pocket such that a portion of the first section engages the clamping surface of the tank. The clamp assembly has a second section with a bottom defining a channel that is configured to receive a portion of the tank frame. The second section is configured to be mounted to the first section with a fastener in a manner that clamps the portion of the tank frame between the tank and the second section.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF EXEMPLARY EMBODIMENTS

Figure 1:
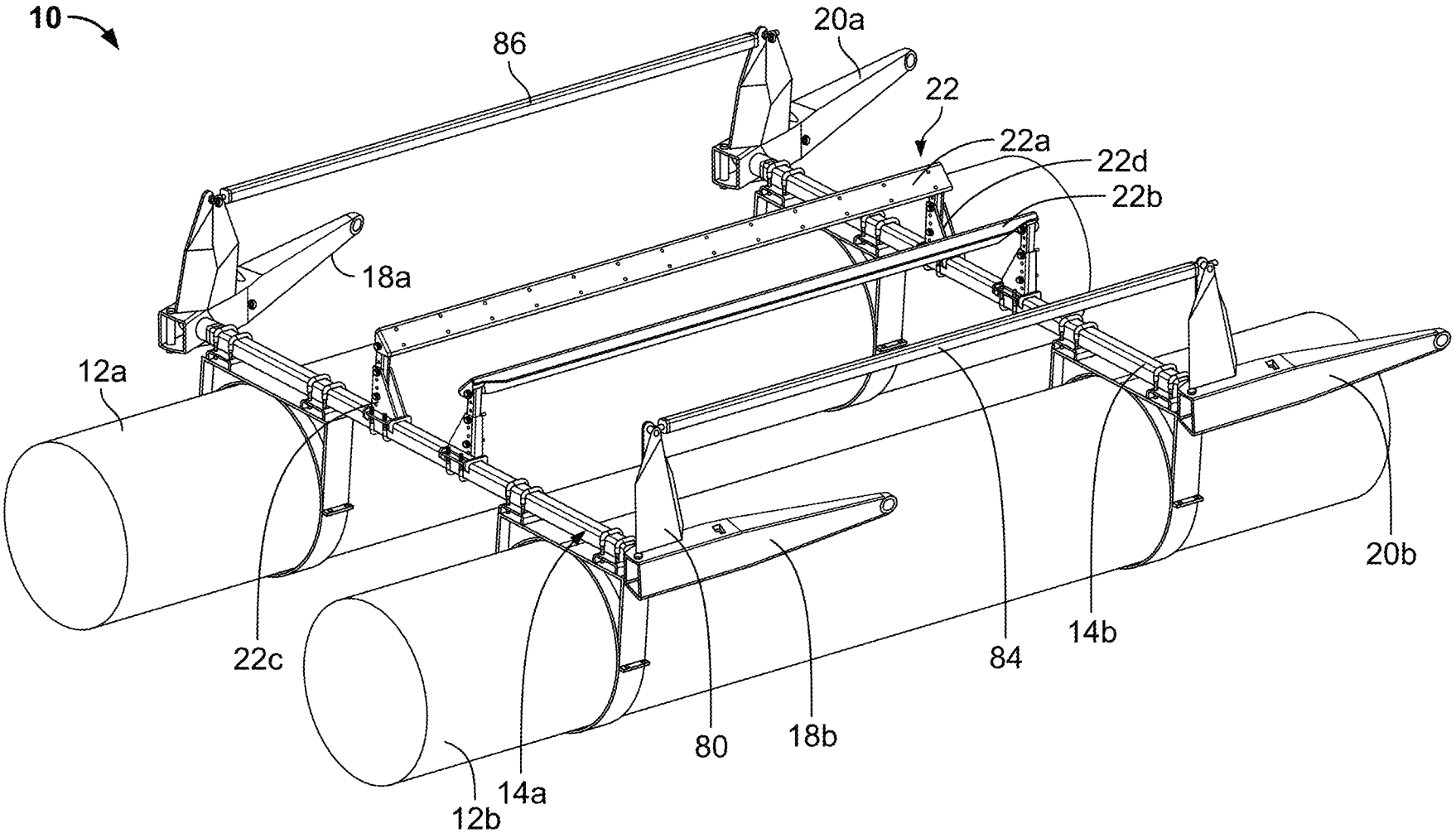
FIG. 1 is a perspective view of a boat lift in accordance with an exemplary embodiment described herein.

A boat lift in accordance with an exemplary embodiment of the invention described herein is identified generally in FIG. 1 as 10. The boat lift 10 is configured for mounting to a dock 11 (FIG. 6) and moving between a raised position shown in FIG. 6, in which the boat lift 10 supports a boat above the surface of a body of water within which the dock is placed, and a lowered position shown in FIG. 7, in which the boat lift 10 is positioned beneath the boat as the boat floats on the body of water. As shown, the boat lift 10 is configured for supporting a boat with a V hull, but it is within the scope of the invention for the boat lift 10 to be configured for supporting any type of suitable watercraft, including a pontoon boat, a tritoon boat, a catamaran, or a personal watercraft. In some embodiments, the boat lift 10 may be easier to assemble, have less parts, and/or a greater strength to weight ratio than a conventional boat lift. Further, in at least some embodiments, the boat lift 10 may have an adjustable width so that it may be mounted to different docks with boat slips having different widths.

As shown in FIG. 1, the boat lift 10 generally includes a pair of tubes or tanks 12*a-b*, a pair of bunk support frames 14*a-b* mounted to the tubes 12*a-b*, a pair of torque bars (one of which is shown as 16 in FIGS. 3-5) supported by the bunk support frames 14*a-b*, respectively, a pair of arms 18*a-b* mounted to opposite ends of the torque bar 16, a second pair of arms 20*a-b* mounted to opposite ends of a second torque bar (not shown), and a bunk assembly 22 mounted to the bunk support frames 14*a-b*.

The tubes 12*a-b* are elongate, arranged generally parallel to each other, and spaced apart by the bunk support frames 14*a-b*. The tubes 12*a-b* are configured to receive water to decrease their buoyancy and lower the boat lift 10 with respect to a body of water within which the boat lift 10 is positioned, and the tubes 12*a-b* are configured to receive air that evacuates the water to increase their buoyancy and raise the boat lift 10 with respect to the body of water. Although the tubes 12*a-b* are shown as being generally cylindrical, they may have any suitable shape.

Figure 2:
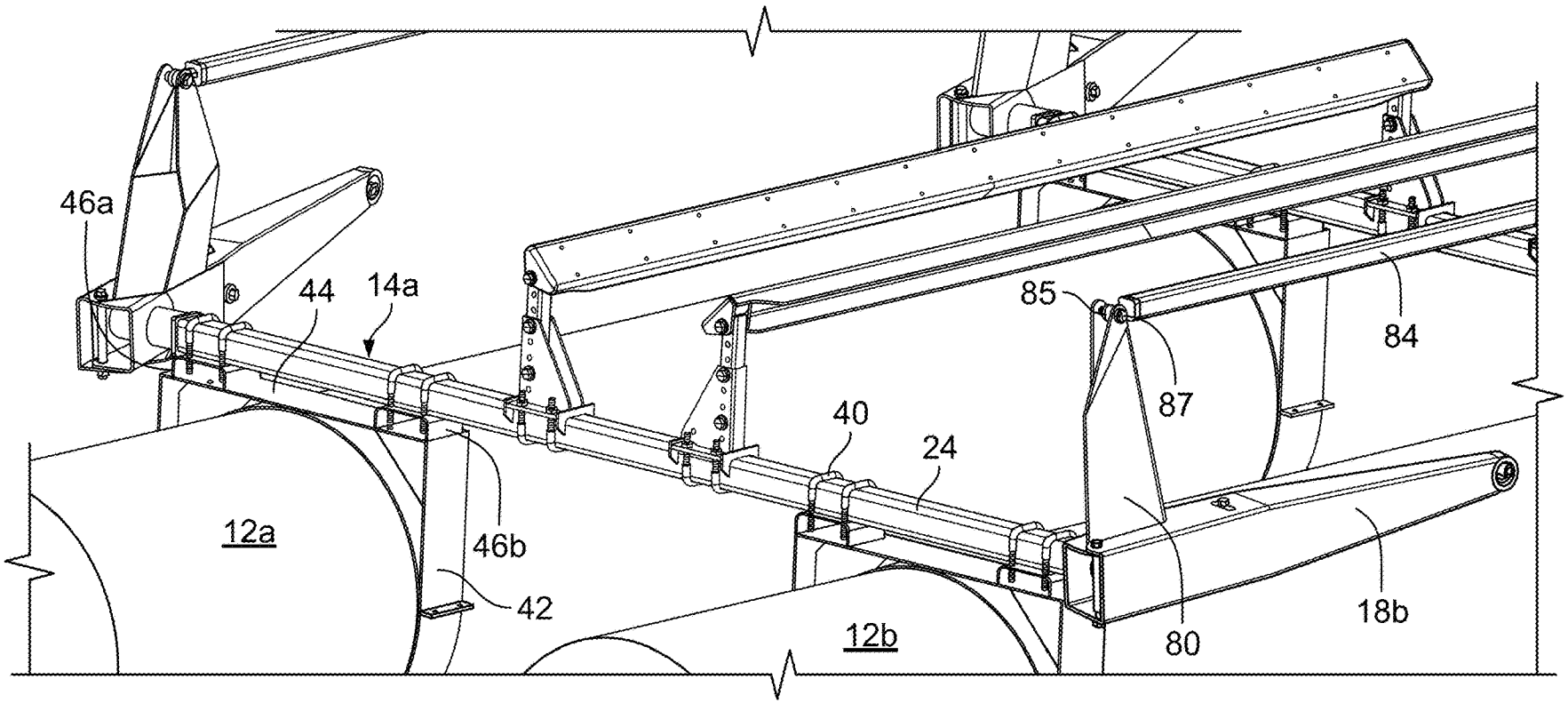
FIG. 2 is a perspective view of a portion of the boat lift shown in FIG. 1.
Figure 3:
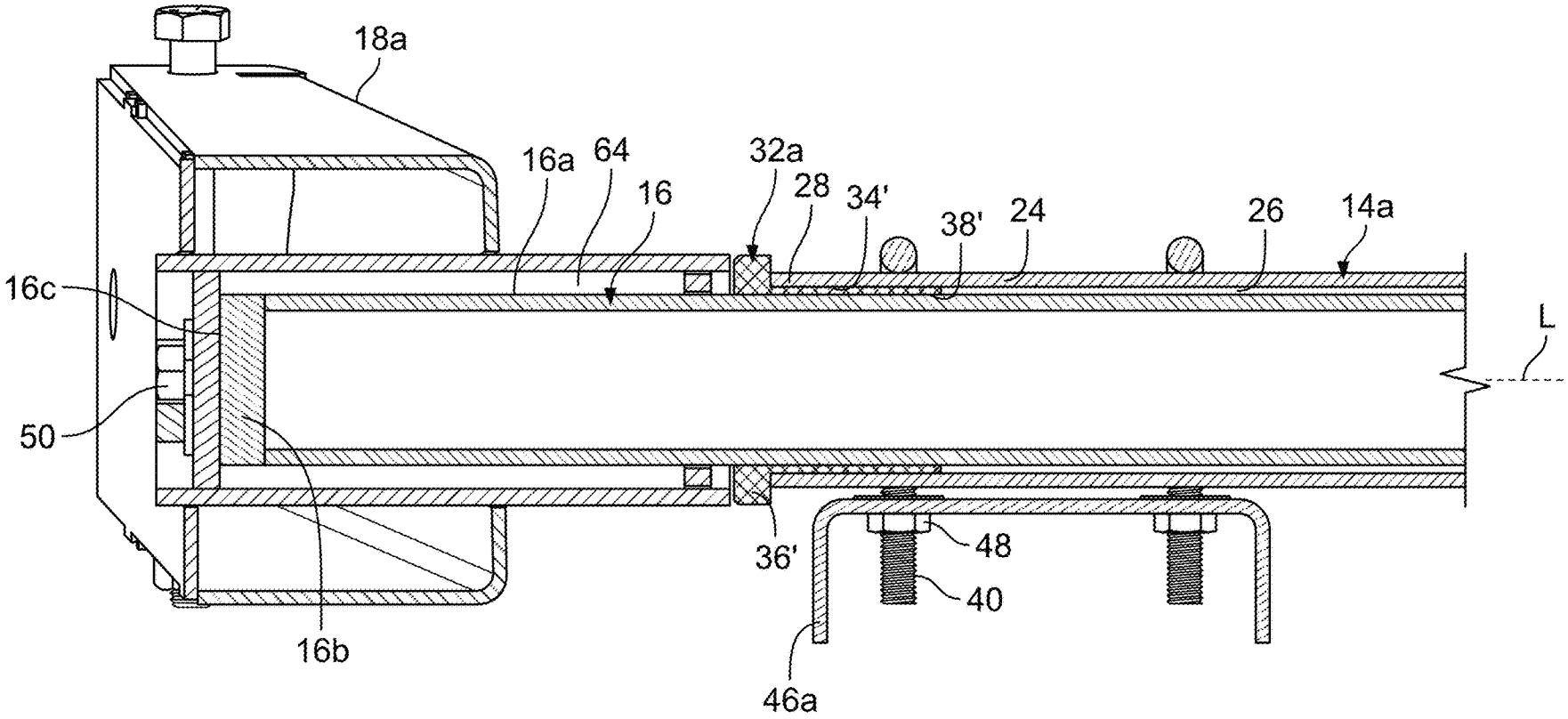
FIG. 3 is a sectional view taken through the line 3-3 in FIG. 8.
Figure 5:
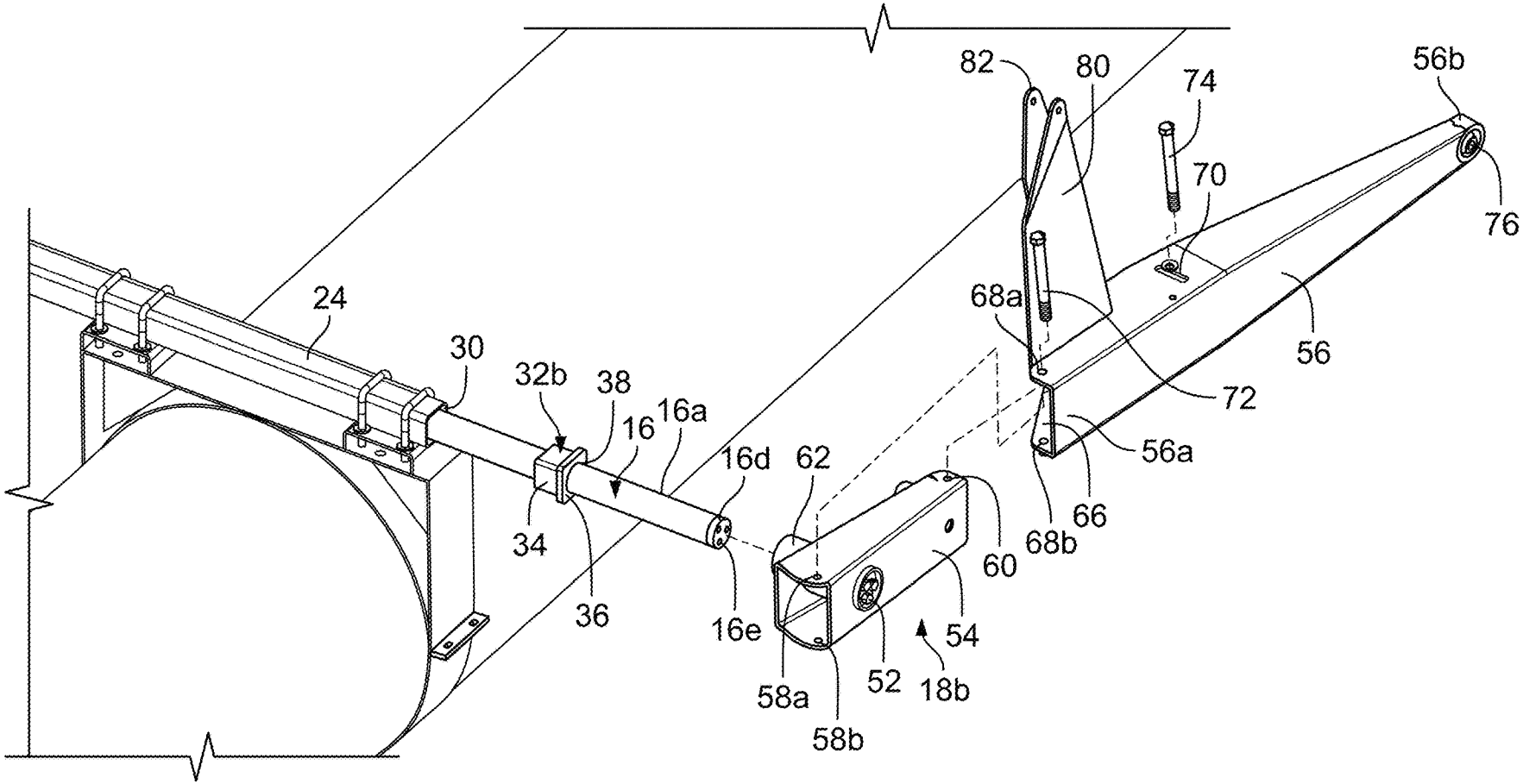
FIG. 5 is another exploded view of the arm shown in FIG. 4.

The bunk support frame 14*a* is mounted to each of the tubes 12*a-b* adjacent a first end of the tubes 12*a-b*, and the bunk support frame 14*b* is mounted to each of the tubes 12*a-b* adjacent a second end of the tubes 12*a-b*. The bunk support frames 14*a-b* have substantially the same structure and are mounted to the tubes 12*a-b* in substantially the same manner. Accordingly, only bunk support frame 14*a* is described in detail herein. As shown in FIGS. 2 and 3, the bunk support frame 14*a* includes a tube 24 with a generally rectangular cross-section. The tube 24 is hollow along its length and defines a channel 26 (FIG. 3) that extends through the tube 24. The channel 26 is accessible through a first opening 28 (FIG. 3) at one end of the bunk support frame 14*a* and a second opening 30 (FIG. 5) at an opposite end of the bunk support frame 14*a*. The bunk support frame 14*a* includes a first support bushing 32*a* (FIG. 3) that is mounted to the tube 24 at the first opening 28, and a second support bushing 32*b* (FIG. 5) that is mounted to the tube 24 at the second opening 30. As shown in FIG. 5, the second support bushing 32*b* includes a first section 34 with a rectangular cross section that is sized for insertion into the channel 26 through the second opening 30 to mount the second support bushing 32*b* to the tube 24. A second section 36 of the second support bushing 32*b* is larger than the second opening 30 and sized to abut the end of the tube 24 when the first section 34 is inserted into the channel 26. A cylindrical opening 38 extends through the second support bushing 32*b*. A surface of the second support bushing 32*b* surrounding the opening 38 forms a bushing surface that supports torque bar 16 and allows the torque bar 16 to rotate with respect to the second support bushing 32*b*. The first support bushing 32*a* shown in FIG. 3 has a substantially similar structure as the second support bushing 32*b*. FIG. 3 shows the first section 34' of the first support bushing 32*a* positioned within the channel 26 and the second section 36' of the first support bushing 32*a* abutting an end of the tube 24. The torque bar 16 extends through an opening 38' defined by the first support bushing 32*a*. The surface surrounding the opening 38' forms a bushing surface that supports the torque bar 16 and allows the torque bar 16 to rotate with respect to the first support bushing 32*a*. The first and second support bushings 32*a-b* may be mounted to the tube 24 with a clearance or press-fit, adhesive, welding, or in any other suitable manner.

Referring to FIG. 2, the bunk support frame 14*a* is releasably mounted to the tubes with eight U-bolts, one of which is identified as 40. Each of the tubes 12*a-b* includes a mounting structure 42 that encircles a cylindrical portion of the tubes 12*a-b*. An upper portion of the mounting structure 42 includes a horizontal plate 44. Two mounts 46*a-b* with an inverted U-shape extend upward from the horizontal plate 44. Each of the mounts 46*a-b* includes four openings (not shown) that are arranged in pairs to receive the threaded ends of two U-bolts 40. Nuts, one of which is identified in FIG. 3 as 48, engage the threaded ends of the U-bolts 40 to secure the bunk support frame 14*a* to the tubes 12*a-b*. The bunk support frame 14*b* is secured to the tubes 12*a-b* in a similar manner.

Although the bunk support frames 14*a-b* are described above and shown in the figures as having a rectangular cross-section, other shapes are within the scope of the invention. Further, although the bunk support frames 14*a-b* are shown and described as having an enclosed channel 26 extending substantially the entire longitudinal length of the bunk support frames 14*a-b*, the channel 26 may not be fully enclosed (e.g., it may be enclosed on three sides, or there may be gaps, slots, or other openings formed in the side walls of the tube) or it may be fully enclosed only along a portion of the length of the bunk support frames 14*a-b*.

Figure 4:
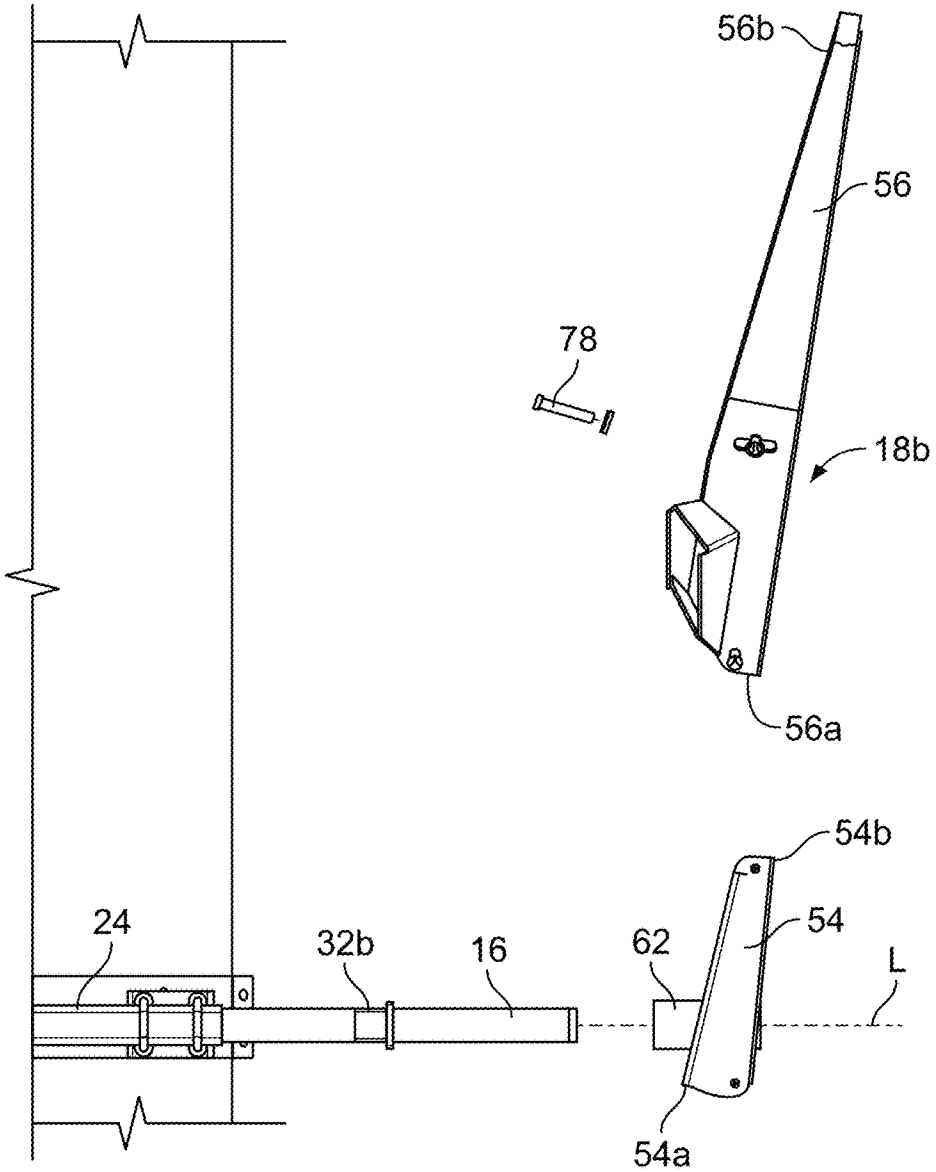
FIG. 4 is an exploded view of an arm of the boat lift shown in FIG. 1.

The torque bar 16, shown in FIGS. 3-5, extends through the channel 26 of the bunk support frame 14*a* from the first opening 28 (FIG. 3) to the second opening 30 (FIG. 5). Further, the torque bar 16 is longer than the tube 24 such that portions of the torque bar 16 extend outward beyond the first and second openings 28 and 30 when the torque bar 16 is received in the channel 26. The tube 24 of the bunk support frame 14*a* encloses the portion of the torque bar 16 that is positioned within the channel 26 between the first and second support bushings 32*a-b*. The torque bar 16 is generally cylindrical and received by the openings 38 and 38' in the first and second support bushings 32*a-b*. As described above, the surfaces of the first and second support bushings 32*a-b* surrounding the openings 38, 38' form bushing surfaces that support the torque bar 16 and allow the torque bar 16 to rotate with respect to the bunk support frame 14*a* about a longitudinal axis L of the torque bar 16. One or more additional bushings may also be positioned in the channel 26 of the bunk support frame 14*a* to support the torque bar 16 at additional locations, as needed. Combining the torque bar 16 and the bunk support frame 14*a* by extending the torque bar 16 through the channel 26 of the bunk support frame 14*a* and supporting the torque bar 16 with first and second support bushings 32*a-b* at ends of the bunk support frame 14*a* may have a greater strength per weight ratio then an arrangement in which the torque bar is supported by bushings mounted externally to the side of the bunk support frame.

As shown in FIG. 3, the torque bar 16 is tubular with a cylindrical side wall 16*a* and a first end wall 16*b* joined to the side wall 16*a* at a first end of the torque bar 16. The first end wall 16*b* has an end surface 16*c* defining three threaded openings (not shown). Fasteners (one of which is identified as 50) are received by openings (not shown) in the first arm 18*a* and engage the threaded openings in the end surface 16*c* to mount the first arm 18*a* to the torque bar 16. FIG. 5 shows a second end of the torque bar 16 with a second end wall 16*d* joined to the side wall 16*a*. The second end wall 16*d* also has an end surface defining three threaded openings (one of which is identified as 16*e*). Fasteners (one of which is identified as 52) are received by openings (not shown) in the second arm 18*b* and engage the threaded openings 16*e* in the second end wall 16*d* to mount the second arm 18*b* to the torque bar 16. The end walls 16*b* and 16*d* may be joined to ends of the side wall 16*a* by welding, for example. Although the torque bar 16 is shown as being a hollow tube, the torque bar 16 may also be solid with the threaded openings 16*e* formed in end surfaces of the solid bar. The boat lift 10 includes another torque bar (not shown) that is substantially similar to torque bar 16 and that extends through the bunk support frame 14*b* (FIG. 1). Arms 20*a-b* are mounted to ends of the torque bar that extends through the bunk support frame 14*b* in a similar manner as described above with respect to mounting of arms 18*a-b* to torque bar 16.

The arms 18*a-b* and 20*a-b* have a substantially similar structure. Accordingly, only arm 18*b* is described in detail herein with reference to FIGS. 4 and 5. Arm 18*b* includes a first section 54 and a second section 56 that is adjustably mounted to the first section 54. The first section 54 is generally shaped as a hollow box with a width that tapers slightly from a first end 54*a* to a second end 54*b*, as shown in FIG. 4. There are a pair of aligned openings 58*a-b* in upper and lower walls at the first end 54*a*, as shown in FIG. 5, and a pair of aligned openings (one of which is shown as 60) in the upper and lower walls at the second end 54*b*. A tube 62 extends laterally across the first section 54 from an outer side wall to an inner side wall. The tube 62 further extends laterally away from the inner side wall toward the tube 24. The tube 62 is hollow and defines a receptacle that receives the outer end of the torque bar 16. For example, the receptacle 64 of first arm 18*a* is shown in FIG. 3 receiving an end of the torque bar 16. The tube 62 extends transverse to a direction extending from the first end 54*a* to the second end 54*b* of the first section 54.

The second section 56 of the arm 18*b* is also shaped as a hollow box with a width that tapers from a first end 56*a* to a second end 56*b*, as shown in FIG. 4. The second section 56 has an opening 66 (FIG. 5) at its first end 56*a* that is sized and configured to receive the first section 54. There are a pair of aligned openings 68*a-b* in upper and lower walls at the first end 56*a*, as shown in FIG. 5, and a pair of aligned slots (one of which is shown as 70) in the upper and lower walls between the first and second ends 56*a-b*. When the first section 54 is inserted in the opening 66 of the second section 56, the openings 58*a-b* align with the openings 68*a-b*. A fastener 72 (e.g., a bolt secured with a nut) inserted through the aligned openings 58*a-b*, 68*a-b* secures the first end 54*a* of the first section 54 to the first end 56*a* of the second section 56. The slot 70 aligns with the opening 60 at the second end 54*b* of the first section 54. A fastener 74 is inserted through the aligned slot 70 and opening 60 to adjustably secure the second section 56 to the first section 54. Alternatively, the slot 70 may be formed in the first section 54 with the opening 60 in the second section 56. The fastener 74 may be a bolt and nut that is loosened to allow the second section 56 to pivot with respect to the first section 54 about an axis aligned with the fastener 72. When the second section 56 is at a desired location, the fastener 74 may be tightened to secure the second section 56 to the first section 54. A spherical bearing 76 (FIG. 5) is mounted in an opening at the second end 56*b* of the second section 56. The bearing 76 receives a fastener (not shown) for mounting the second end 56*b* of the second section 56 to a dock.

Adjustment of the second section 56 relative to the first section 54 via the slot 70 allows the second end 56*b* to move laterally toward and away from the tube 24 in a direction that is generally aligned with the longitudinal axis L (FIG. 4) of the torque bar 16. Due to the pivoting of the second section 56 as it is adjusted relative to the first section 54, the second end 56*b* will move about an arc as it is adjusted. The distance from the pivot axis at fastener 72 to the second end 56*b* is such that the second end 56*b* mostly moves in a direction that is aligned with the longitudinal axis L of the torque bar 16. The second end 56*b* will also move at least partially in a direction perpendicular to the longitudinal axis L, or toward the torque bar 16 as the second end 56*b* moves laterally outward, and away from the torque bar 16 as the second end 56*b* moves laterally inward. The bearing 76 allows a fastener extending through the bearing to remain generally parallel to the longitudinal axis L as the second section 56 moves with respect to the first section 54. When the second section 56 is in a desired position with respect to the first section, a set screw 78 (FIG. 4) or other type of fastener may engage aligned openings in inner side walls of the first section 54 and second section 56 to secure the second section 56 relative to the first section 54. The arms 18*a* and 20*a-b* have a first section and a second section that is laterally adjustable with respect to the first section in a similar manner as described above with respect to arm 18*b*.

In at least some embodiments of the boat lift 10, the arms 18*a-b* and 20*a-b* may be structured so that they are not adjustable. For example, the arms 18*a-b* and 20*a-b* may not include the slot 70 (FIG. 5) that allows adjustability of the second section 56 relative to the first section 54. The arms 18*a-b* and 20*a-b* may also be formed so that the first section 54 and second section 56 are integrally formed together.

As shown in FIG. 5, a bracket 80 extends upward from the first end 56*a* of the second section 56. The bracket 80 extends upward from the first end 56*a* in a direction that is generally perpendicular to a direction extending from the first end 56*a* to the second end 56*b*. The bracket 80 may be welded to the second section 56 of the arm 18*b*. A pair of tabs 82 at an end of the bracket 80 are spaced apart and have aligned openings for receiving a fastener 87 (FIG. 2) to mount an end of a stabilizer 84 (FIG. 1) to the bracket 80. A rod end 85 (FIG. 2) with a spherical bearing is mounted to the end of the stabilizer 84. The rod end 85 receives the fastener 87 that mounts the stabilizer 84 to the bracket 80. The rod end 85 allows adjustment of the arm 18*b*, as described above, while maintaining the fastener 87 in a position that is generally perpendicular to the length of the stabilizer 84. As shown in FIG. 1, the stabilizer 84 extends between the bracket 80 of arm 18*b* and a bracket of arm 20*b*. The stabilizer 84 extends in a direction that is generally parallel to the tubes 12*a-b*. Another stabilizer 86 is mounted to brackets of arms 18*a* and 20*a* in a similar manner. The stabilizers 84 and 86 help to ensure that the boat lift 10 remains parallel to the upper surface of the dock to which it is mounted as the boat lift 10 is raised and lowered in the water.

As shown in FIG. 1, the bunk assembly 22 includes a first bunk 22*a* and a second bunk 22*b* that are arranged at an angle with respect to a horizontal plane including the upper surfaces of the bunk support frames 14*a-b*. The first bunk 22*a* and second bunk 22*b* are configured to support a boat with a V hull, but as described above, the boat lift 10 may include bunks for supporting any type of suitable watercraft. The first bunk 22*a* includes a first support 22*c* mounted to the bunk support frame 14*a* and a second support 22*d* mounted to the bunk support frame 14*b*. The first and second supports 22*c-d* extend upward from the bunk support frames 14*a-b* in a direction that is generally perpendicular to the longitudinal axis L (FIG. 4) to space the bunks 22*a-b* above the bunk support frames 14*a-b* a suitable distance. The first and second supports 22*c-d* may be mounted to the bunk support frames 14*a-b* in any suitable manner, including U-shaped bolts that are received by openings in the supports 22*c-d* and that wrap around the bunk support frames 14*a-b*. The second bunk 22*b* includes similar supports mounted to the bunk support frames 14*a-b*.

Figure 6:
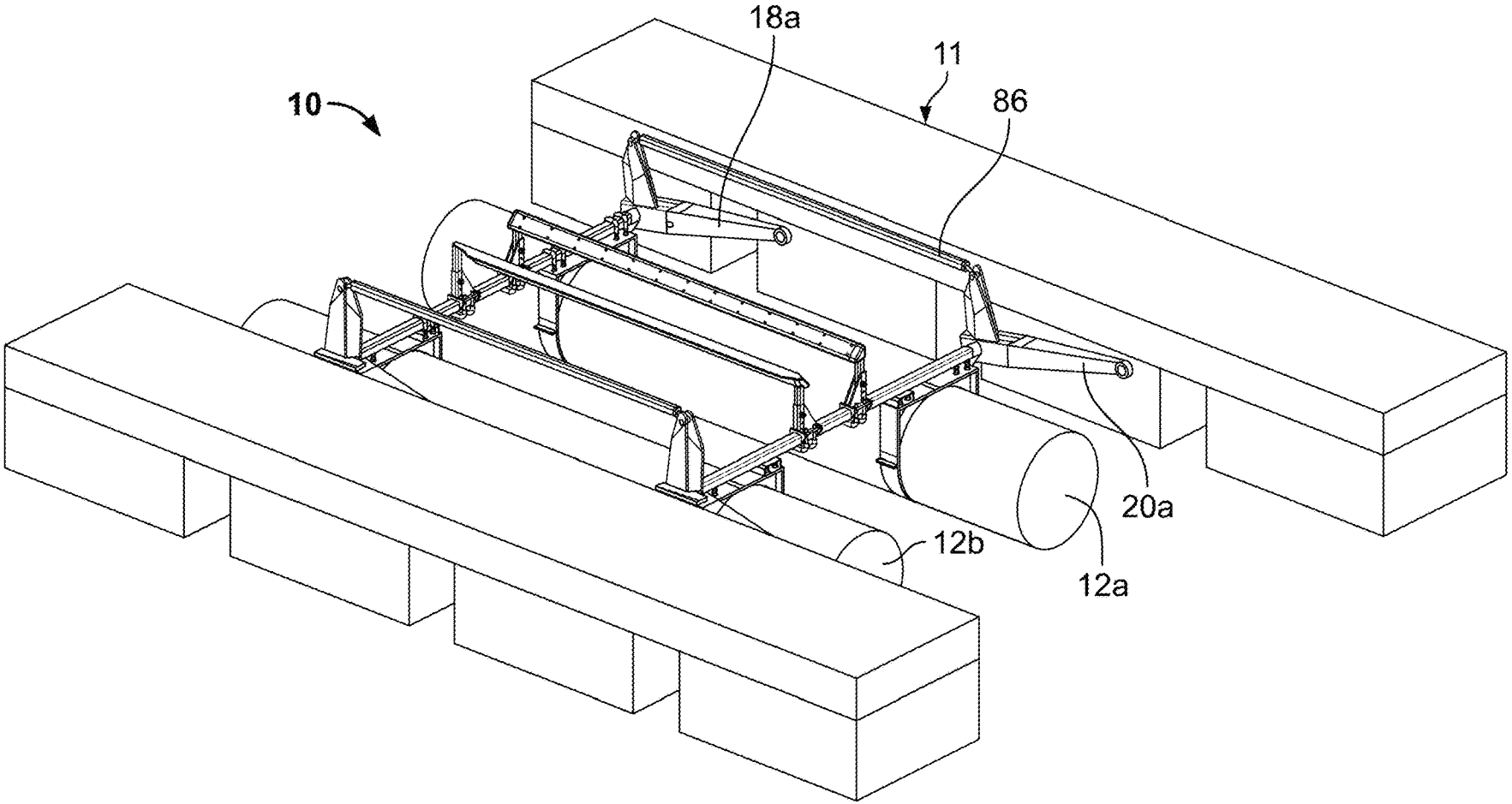
FIG. 6 is a perspective view of the boat lift mounted to a dock and positioned in a raised position.
Figure 7:
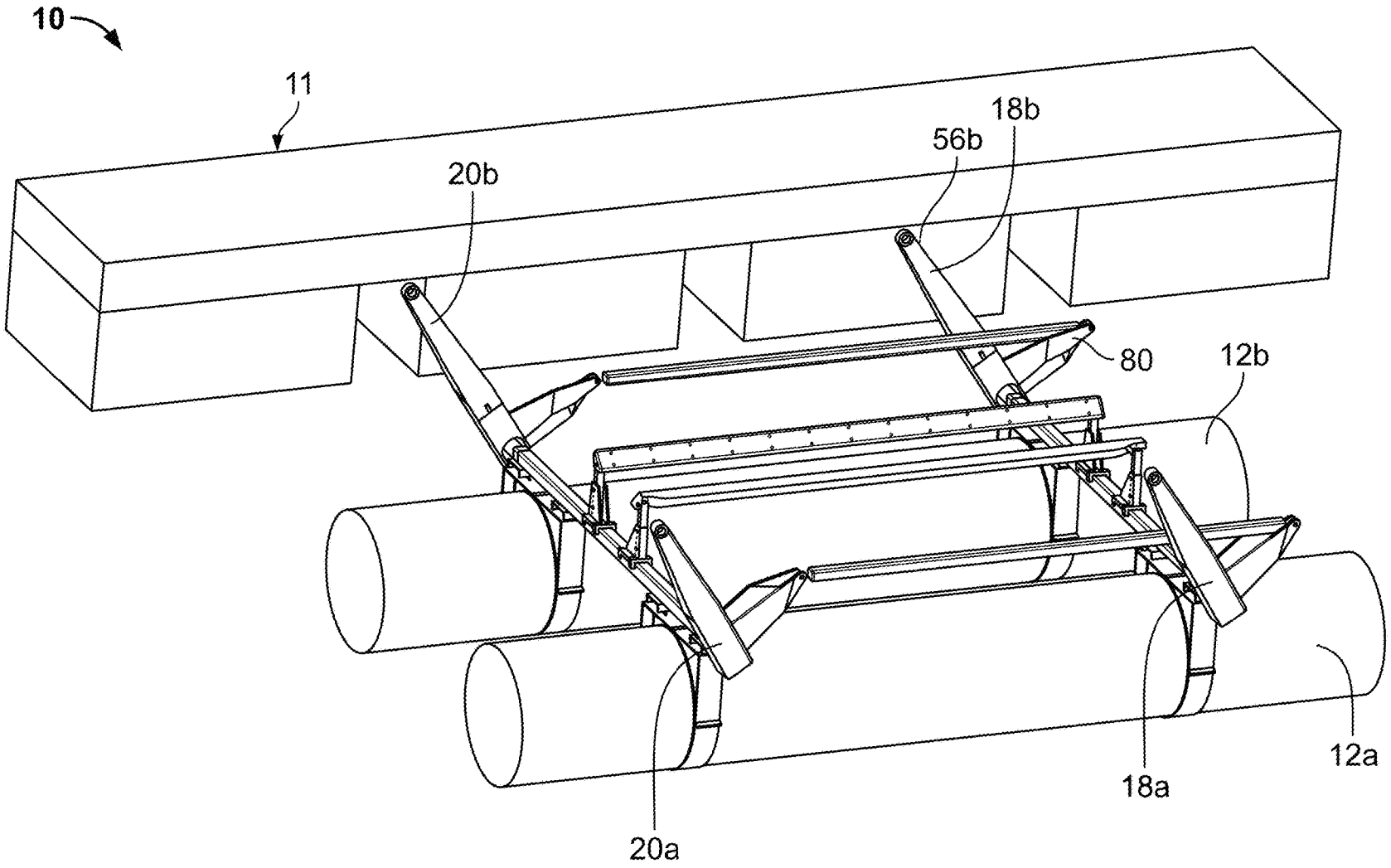
FIG. 7 is a perspective view of the boat lift positioned in a lowered position relative to the dock.

FIG. 6 shows a raised position of the boat lift 10, and FIG. 7 shows a lowered position of the boat lift 10. The second end of each arm 18*a-b* and 20*a-b* (e.g., second end 56*b* shown in FIGS. 5 and 7) is mounted to sides of the dock 11 (or other structure mounted to the dock 11) in a manner that allows the arms 18*a-b* and 20*a-b* to pivot with respect to the dock 11. As shown in FIG. 6, when in the raised position, the arms 18*a* and 20*a* are generally horizontal with the brackets to which the stabilizer 86 is mounted extending generally vertically upward from the arms 18*a* and 20*a*. When air is released from the tubes 12*a-b* and they fill with water, the tubes 12*a-b* sink in the water and the arms 18*a* and 20*a* pivot in a counterclockwise direction when viewed as shown in FIG. 6. As shown in FIG. 7, when the boat lift 10 is in a lowered position, the arms 18*a-b* and 20*a-b* are generally vertical and the brackets 80 extend generally horizontally from the arms 18*a-b* and 20*a-b*. Pivoting of the arms 18*a-b* and 20*a-b* as the boat lift 10 is raised and lowered causes the torque bar 16 to rotate with respect to the bunk support frame 14*a*.

Figure 8:
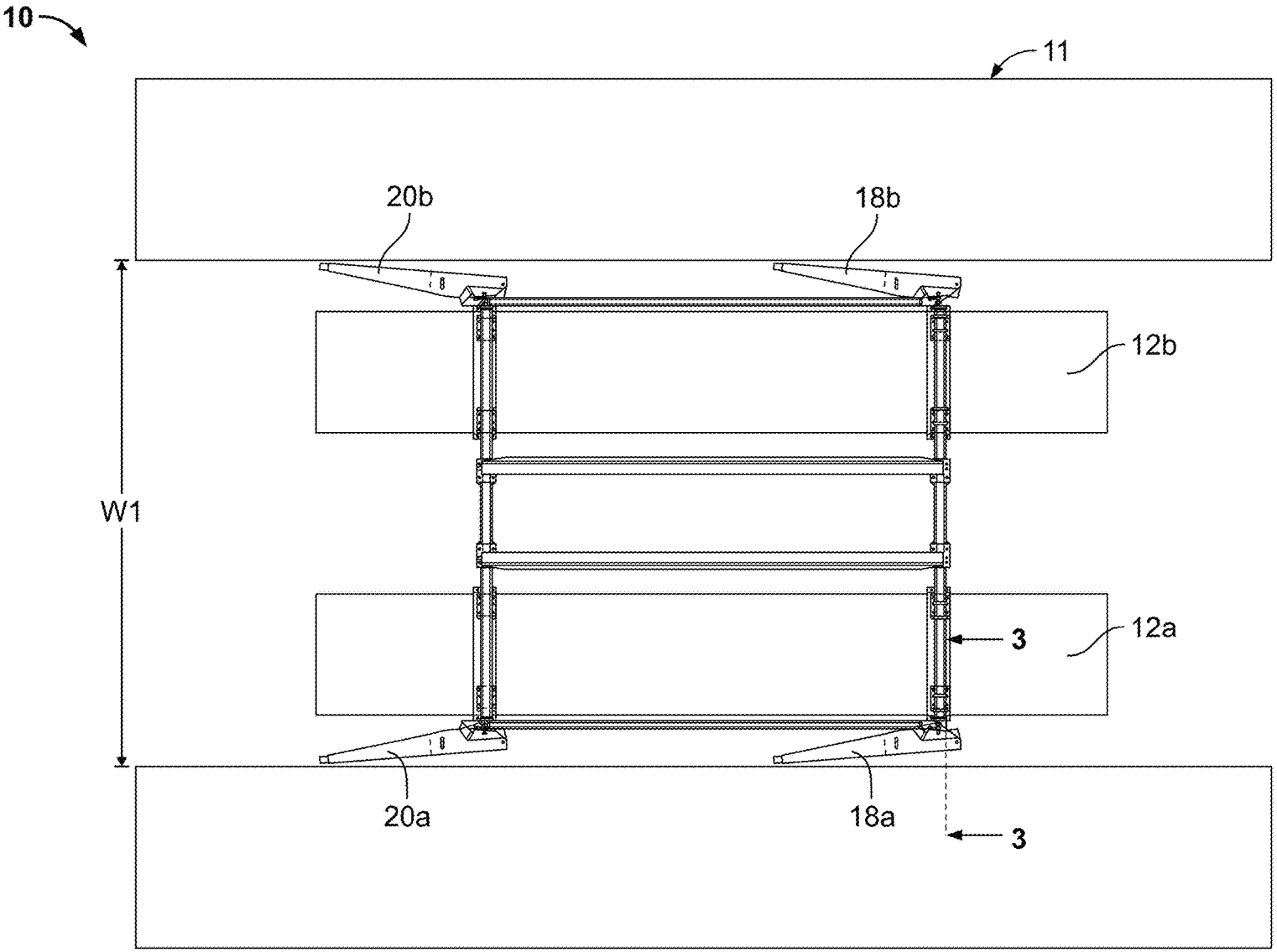
FIG. 8 is a top plan view of the boat lift with arms positioned for mounting to a dock at a first width.
Figure 9:
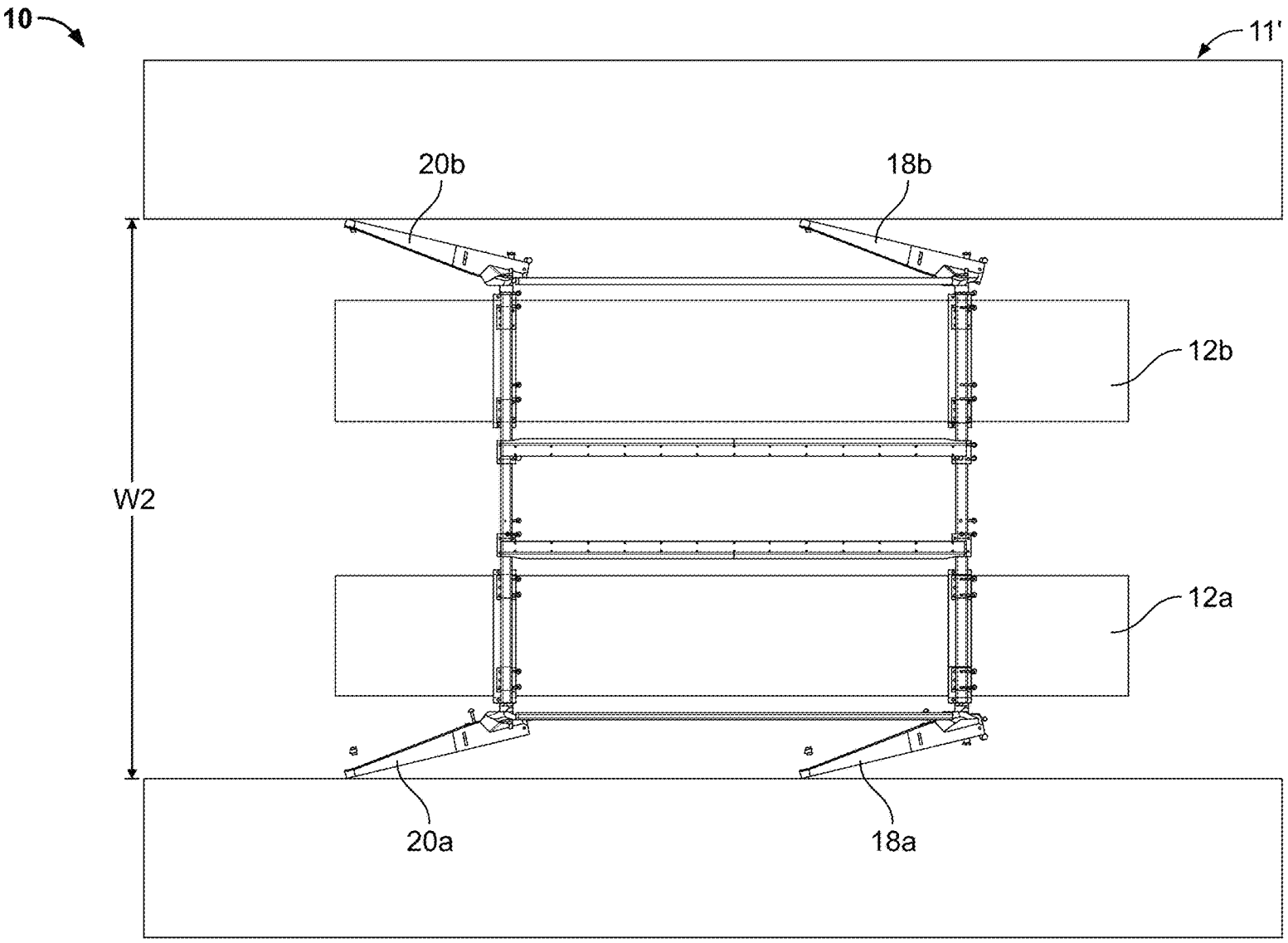
FIG. 9 is a top plan view of the boat lift with arms positioned for mounting to a dock at a second width.

FIGS. 8 and 9 show the boat lift 10 mounted to docks 11 and 11' that have boat slips of different widths. FIG. 8 shows the boat lift 10 mounted to the dock 11, which has a boat slip with a relatively narrow width W1. FIG. 9 shows the boat lift 10 mounted to a dock 11', which has a boat slip with a wider width W2. As shown in FIG. 8, the arms 18*a-b* and 20*a-b* are adjusted so that the ends of the arms that are mounted to the dock 11 are relatively close to the tubes 12*a-b*. For the wider boat slip shown in FIG. 9, the arms 18*a-b* and 20*a-b* are adjusted so that the ends of the arms that are mounted to the dock 11' are farther away from the tubes 12*a-b* than they are for the dock 11 shown in FIG. 8.

Figure 10:
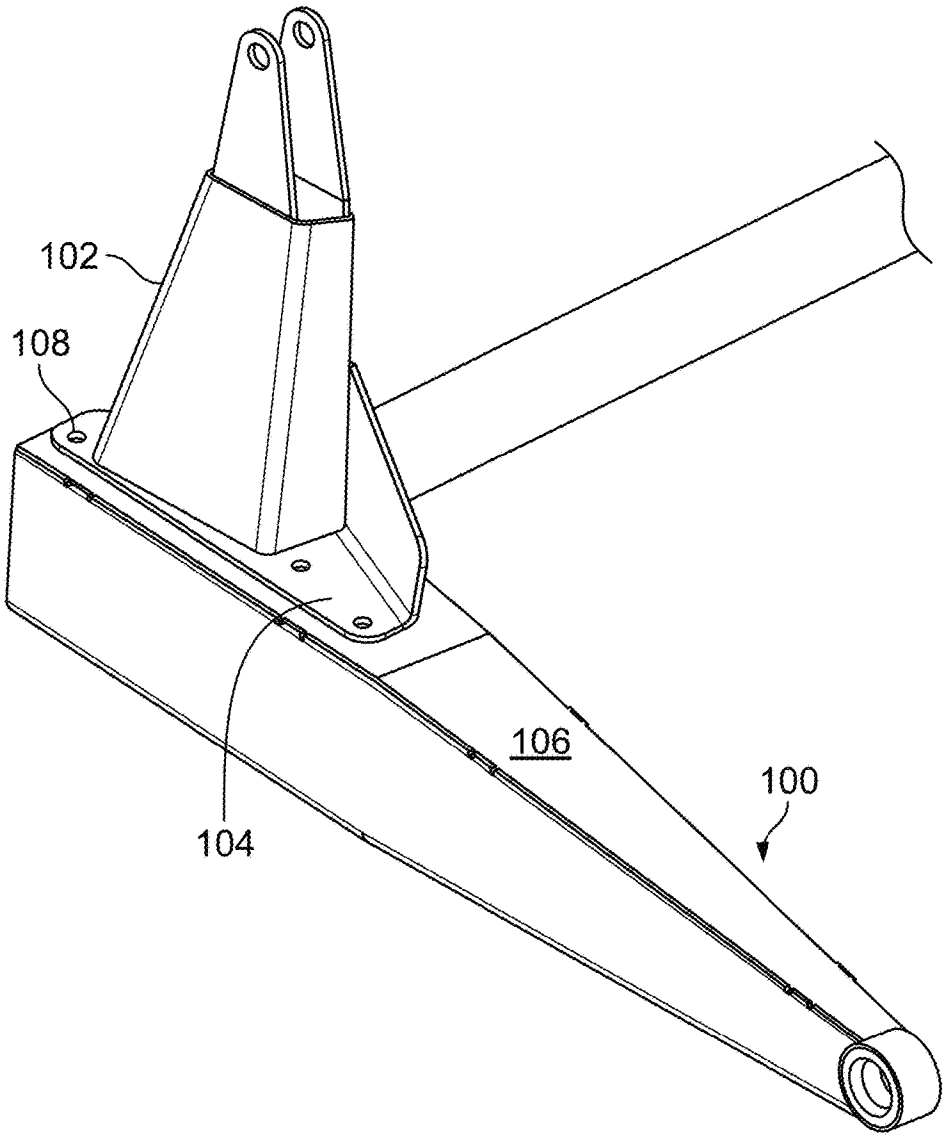
FIG. 10 is a perspective view of an alternative arm that may be used with the boat lift shown in FIG. 1.

FIG. 10 shows an alternative embodiment of arm 100 with a bracket 102 mounted to the arm 100 with fasteners (not shown) such as bolts and nuts. The bracket 102 includes a mounting plate 104 that is positioned on an upper surface 106 of the arm 100. A plurality of holes, one of which is identified as 108, extend through the mounting plate 104. The holes 108 are aligned with holes (not shown) extending through the upper surface 106. The aligned holes receive fasteners (not shown) to mount the bracket 102 to the arm 100. The arm 100 may otherwise be structured and function as described above with respect to arm 18*b*.

While the boat lift 10 is shown with two tubes 12*a-b*, it may include more than two tubes arranged generally parallel to each other and mounted to the bunk support frames 14*a-b*. Further, while the boat lift 10 is shown with two frames 14*a-b*, each having an associated torque bar 16 and pair of arms 18*a-b*, 20*a-b*, the boat lift 10 may include more than two frames, with each of the additional frames mounted to the tubes 12*a-b* and including a torque bar and arms mounted at the ends of the torque bar.

In operation, the boat lift 10 is positioned in the lowered position shown in FIG. 7 to lower a boat in the water. When the boat returns, it is positioned above the boat lift 10. A pneumatic control system of the boat lift 10 is actuated to pump air into the tubes 12*a-b* so that the tubes 12*a-b* begin to rise within the water. As the boat lift 10 rises within the water, the bunk assembly 22 engages the hull of the boat and lifts the boat out of the water.

Figure 11:
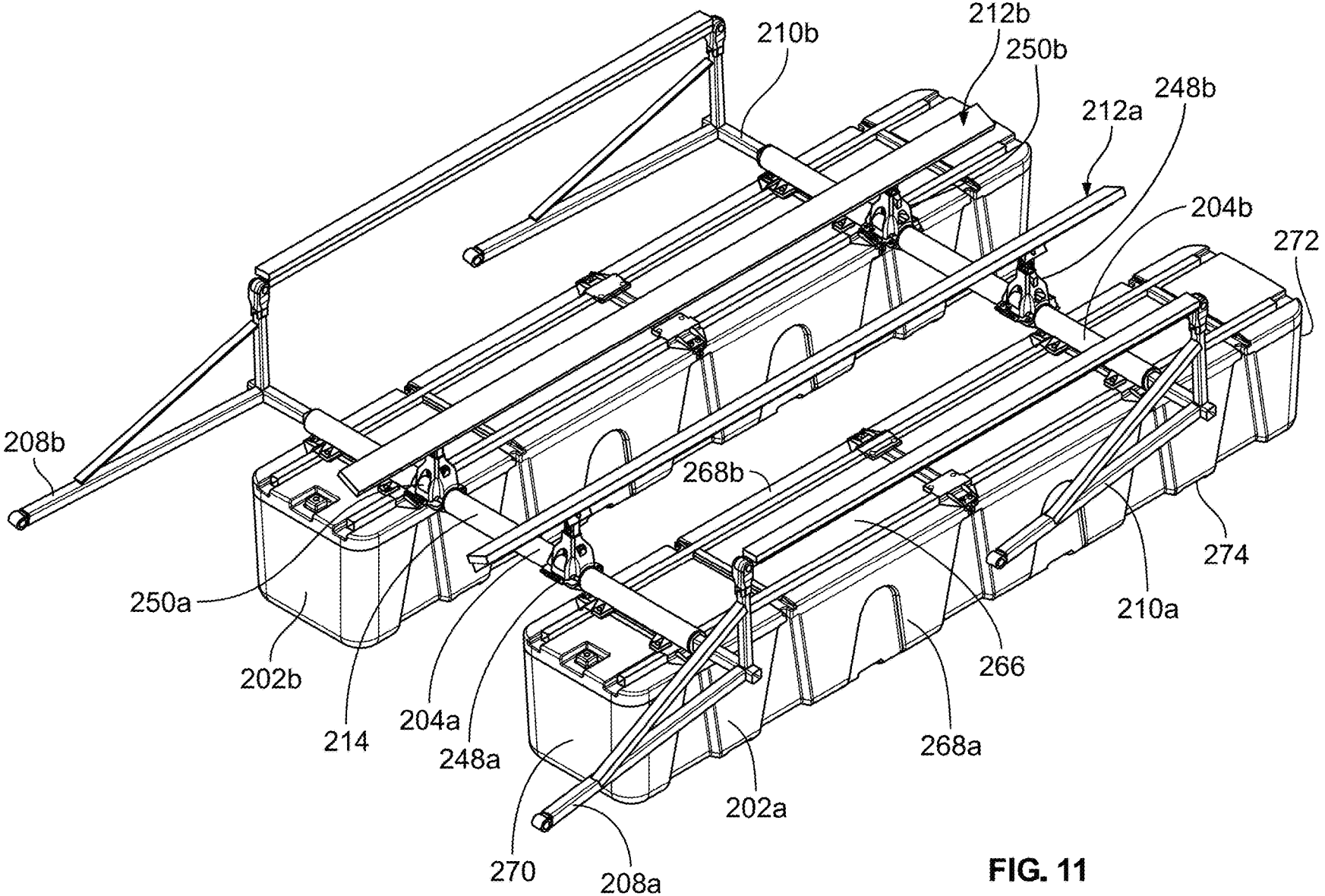
FIG. 11 is a perspective view of an alternative embodiment of boat lift.

An alternative embodiment of boat lift 200 is shown in FIGS. 11-28. As shown in FIG. 11, the boat lift 200 generally includes a pair of tubes or tanks 202*a-b*, a pair of bunk support frames 204*a-b* mounted to the tanks 202*a-b*, a pair of torque bars (one of which is shown as 206 in FIGS. 17-20) supported by the bunk support frames 204*a-b*, respectively, a pair of arms 208*a-b* mounted to opposite ends of the torque bar 206, a second pair of arms 210*a-b* mounted to opposite ends of a second torque bar (not shown), and first and second bunk assemblies 212*a-b* mounted to the bunk support frames 204*a-b*. Boat lift 200 may be mounted to a dock and raised and lowered in a similar manner as described above with respect to boat lift 10.

The tanks 202*a-b* are elongate, arranged generally parallel to each other, and spaced apart by the bunk support frames 204*a-b*. The tanks 202*a-b* are configured to receive water to decrease their buoyancy and lower the boat lift 200 with respect to a body of water within which the boat lift 200 is positioned, and the tanks 202*a-b* are configured to receive air that evacuates the water to increase their buoyancy and raise the boat lift 200 with respect to the body of water. Although the tanks 202*a-b* are shown as being generally box shaped, they may have any suitable shape. The tanks 202*a-b* may be formed from a polymeric material, for example, by rotational molding.

The bunk support frame 204*a* is mounted to each of the tanks 202*a-b* adjacent a first end of the tanks 202*a-b*, and the bunk support frame 204*b* is mounted to each of the tanks 202*a-b* adjacent a second end of the tanks 202*a-b*. The bunk support frames 204*a-b* have substantially the same structure and are mounted to the tanks 202*a-b* in substantially the same manner. Accordingly, only bunk support frame 204*a* is described in detail herein. The bunk support frame 204*a* includes a cylindrical tube 214. The tube 214 is hollow along its length and defines a channel 216 (FIG. 17) that extends through the tube 214. The channel 216 is accessible through a first opening 218 at one end of the bunk support frame 204*a* and a second opening 220 at an opposite end of the bunk support frame 204*a*. The bunk support frame 204*a* includes a first support bushing 222*a* (FIG. 18) that is mounted to the tube 214 at the first opening 218, and a second support bushing 222*b* (FIG. 17) that is mounted to the tube 214 at the second opening 220. As shown in FIG. 18, the first support bushing 222*a* includes a first cylindrical section 224 that is sized for insertion into the channel 216 through the first opening 218 to mount the first support bushing 222*a* to the tube 214. A second section 226 of the first support bushing 222*a* is larger than the first opening 218 and sized to abut the end of the tube 214 when the first section 224 is inserted into the channel 216. A square shaped opening 228 (FIG. 20) extends through the first support bushing 222*a*. A surface of the first support bushing 222*a* surrounding the opening 228 forms a bushing surface that supports arm 208*a*, which is mounted to torque bar 206 as described below. The first support bushing 222*a*, arm 208*a*, and torque bar 206 are rotatable together with respect to the tube 214. The second support bushing 222*b* shown in FIG. 17 has a substantially similar structure as the first support bushing 222*a*. The second support bushing 222*b* supports arm 208*b*, which is mounted to torque bar 206, so that second support bushing 222*b*, arm 208*b*, and torque bar 206 are rotatable together with respect to the tube 214. A bushing retainer 230 (shown in FIG. 19) mounts to the outside of arm 208*a* adjacent the first support bushing 222*a*. The bushing retainer 230 is formed from two sections that can be joined together with fasteners (not shown) to securely clamp the bushing retainer 230 to the first arm 208*a* and prevent the first support bushing 222*a* from moving out of the first opening 218 in the tube 214.

Figure 17:
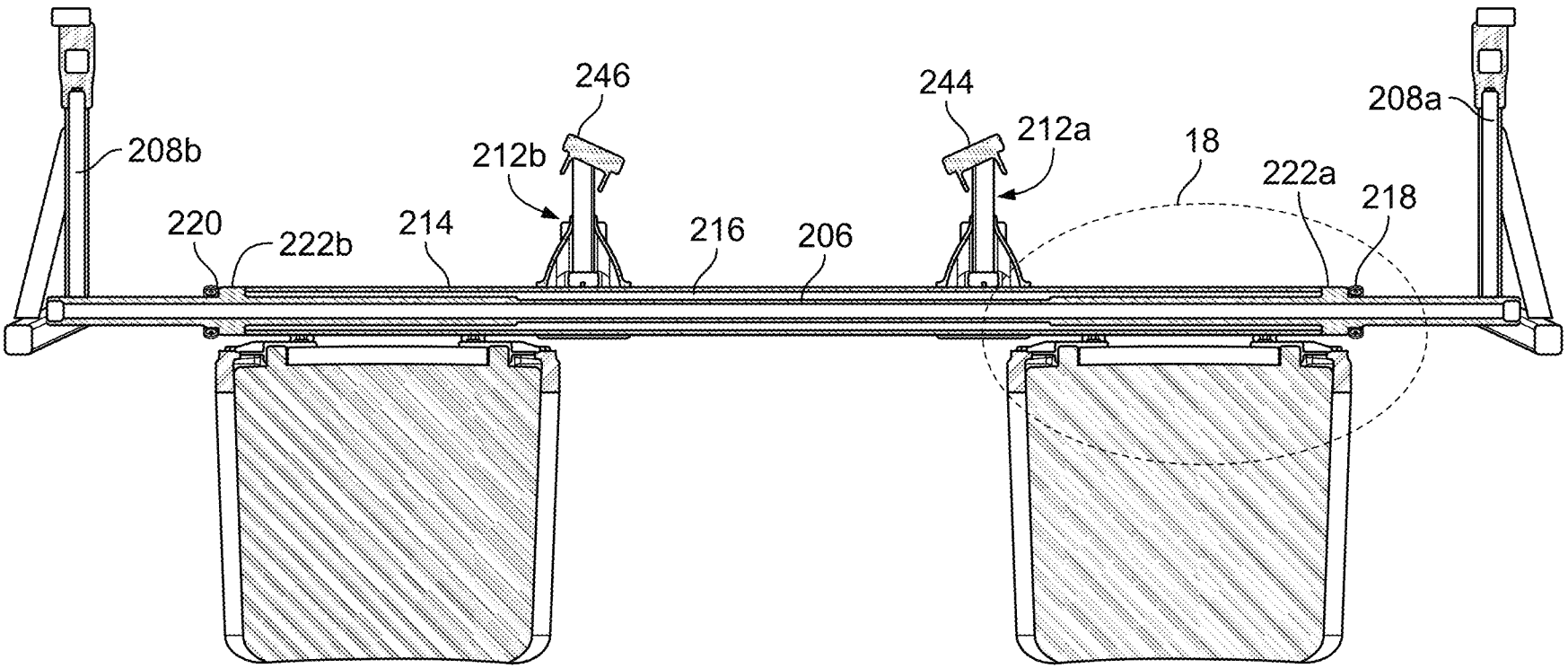
FIG. 17 is a cross-sectional view taken through the line 17-17 in FIG. 12.
Figure 18:
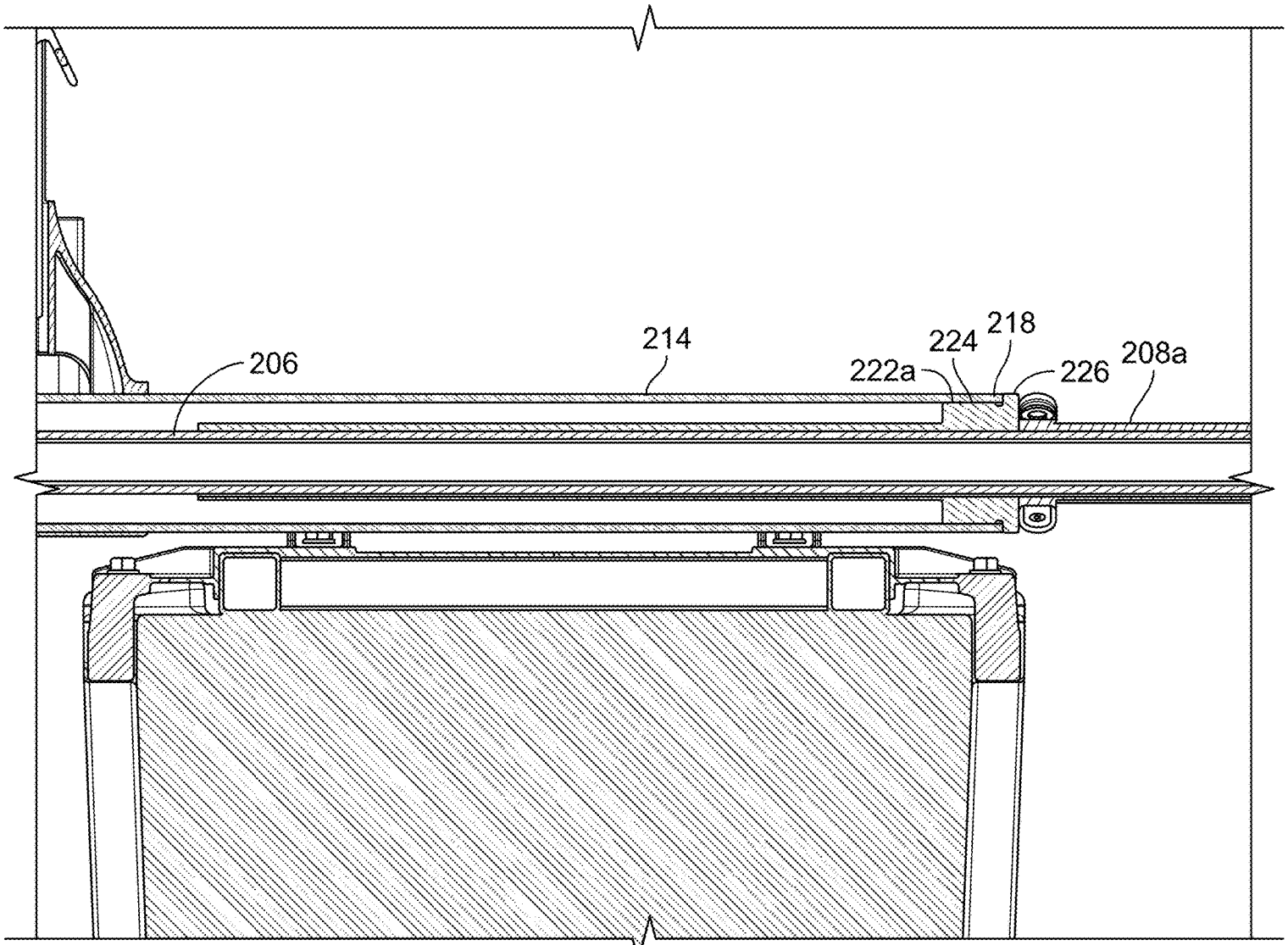
FIG. 18 is a detail view of the area 18 shown in FIG. 17.
Figure 19:
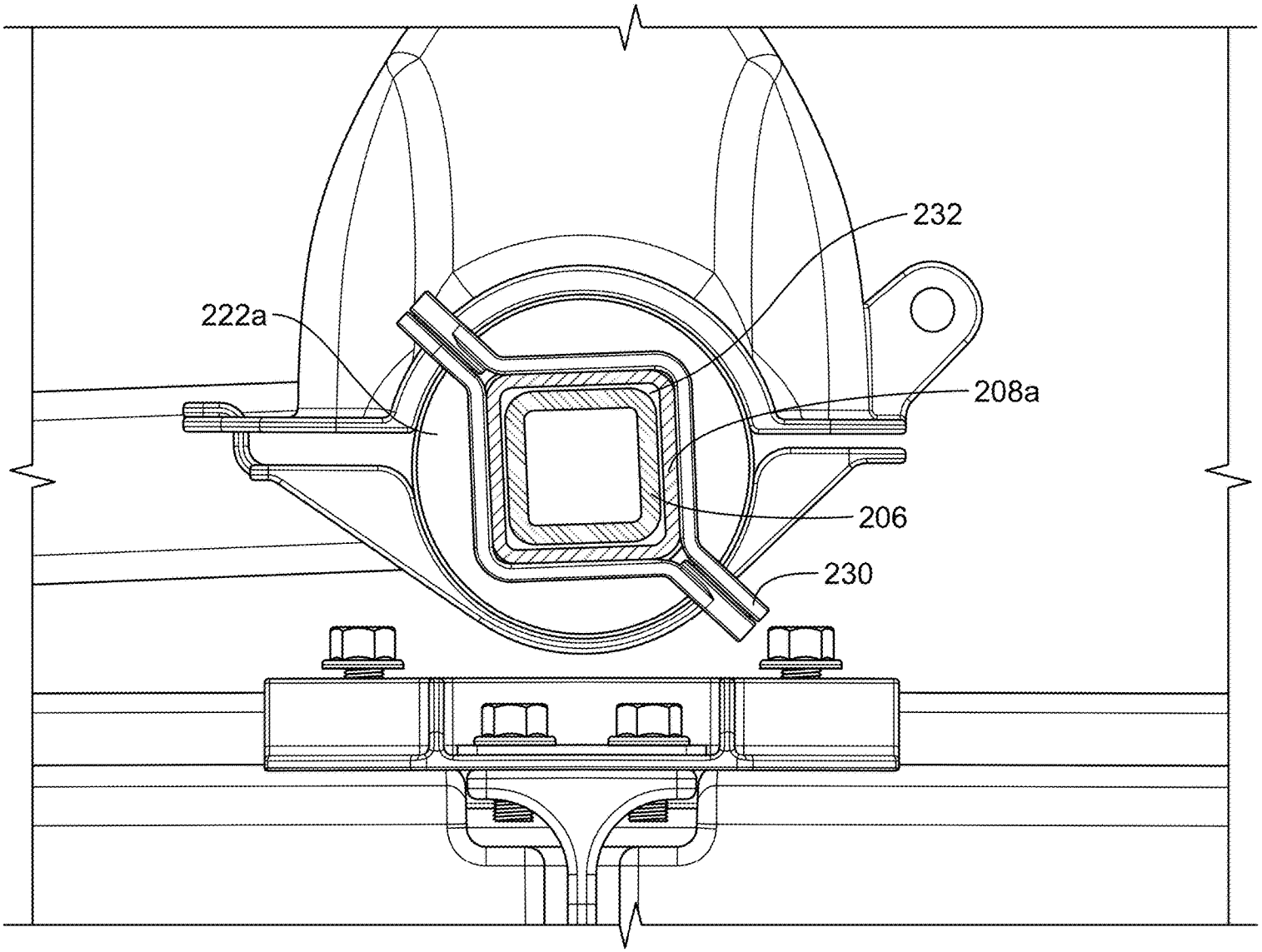
FIG. 19 is a cross-sectional view taken through the line 19-19 in FIG. 12.
Figure 20:
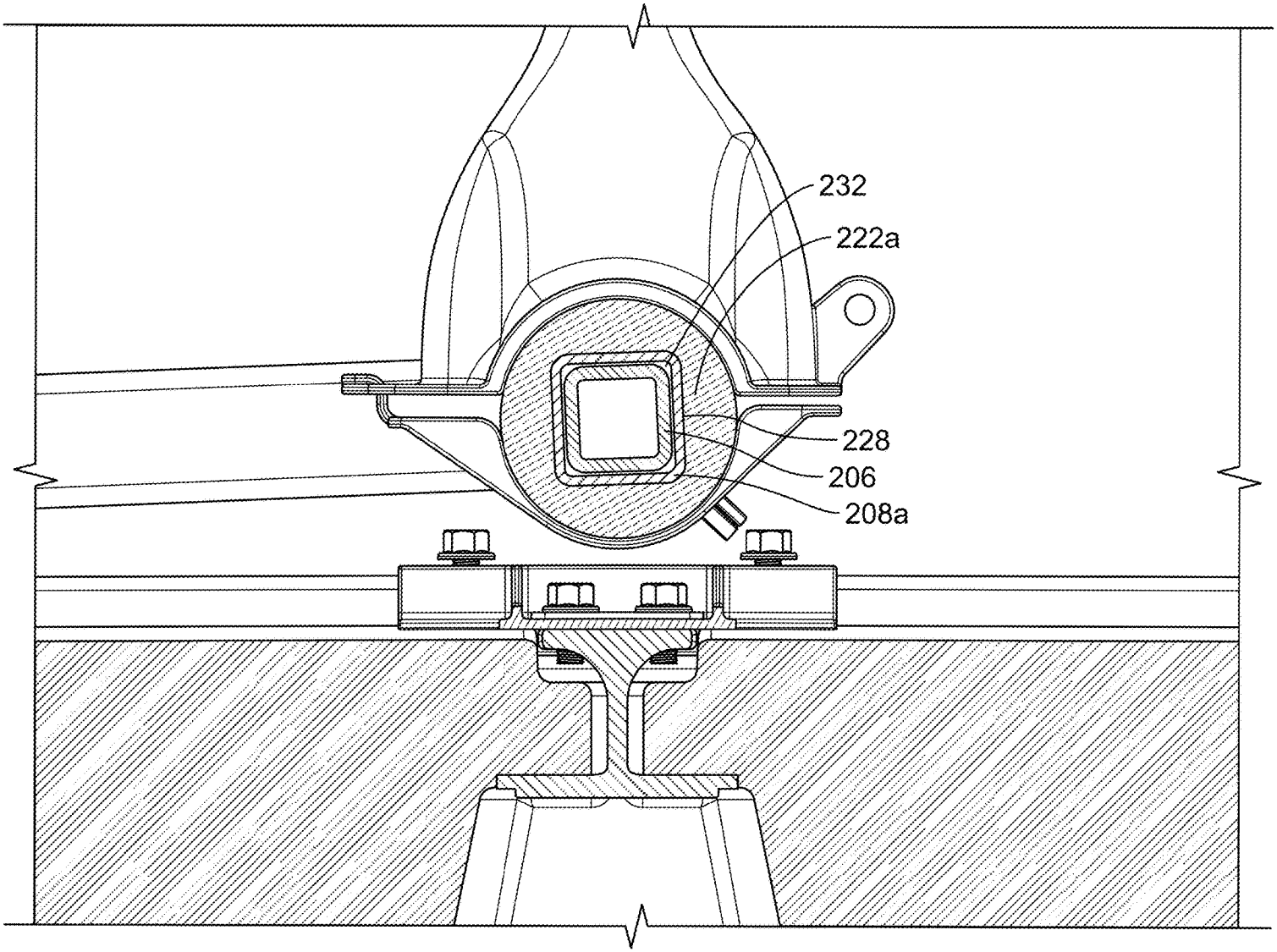
FIG. 20 is a cross-sectional view taken through the line 20-20 in FIG. 12.
Figure 21:
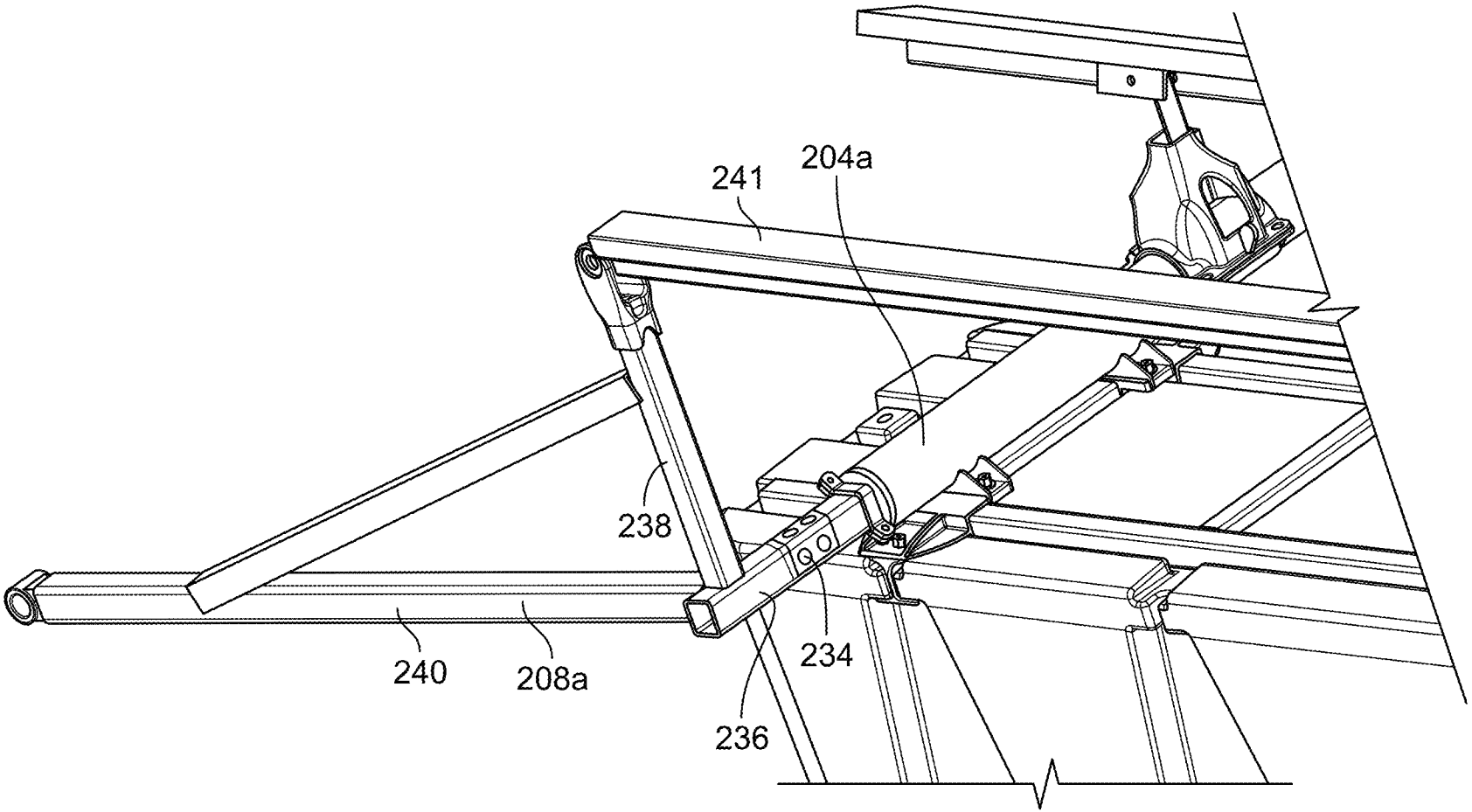
FIG. 21 is a perspective view of an arm of the boat lift of FIG. 11.

The torque bar 206, shown in FIGS. 17-18, extends through the channel 216 of the bunk support frame 204*a* from the first opening 218 to the second opening 220. Further, the torque bar 206 is longer than the tube 214 such that portions of the torque bar 206 extend outward beyond the first and second openings 218 and 220 when the torque bar 206 is received in the channel 216. The tube 214 of the bunk support frame 204*a* encloses the portion of the torque bar 206 that is positioned within the channel 216 between the first and second support bushings 222*a-b*. The torque bar 206 has a generally square or rectangular cross-section and is received within a channel 232 of the arm 208*a*, as shown in FIG. 20. This positions the arm 208*a* between the torque bar 206 and the first support bushing 222*a*. The torque bar 206 is received within a similar channel (not shown) of the arm 208*b* to position the arm 208*b* between the torque bar 206 and the second support bushing 222*b*. Referring to FIG. 21, the arm 208*a* is mounted to the torque bar 206 with four set screws, one of which is identified as 234. The set screw 234 extends through an opening in the arm 208*a* and engages an outer surface of the torque bar 206 to fix the torque bar 206 in place relative to the arm 208*a*. The torque bar 206 is mounted to the arm 208*b* with set screws in a similar manner.

The boat lift 200 includes another torque bar (not shown) that is substantially similar to torque bar 206 and that extends through the bunk support frame 204*b* (FIG. 11). Arms 210*a-b* are mounted to ends of the torque bar that extends through the bunk support frame 204*b* in a similar manner as described above with respect to mounting of arms 208*a-b* to torque bar 206.

Figure 12:
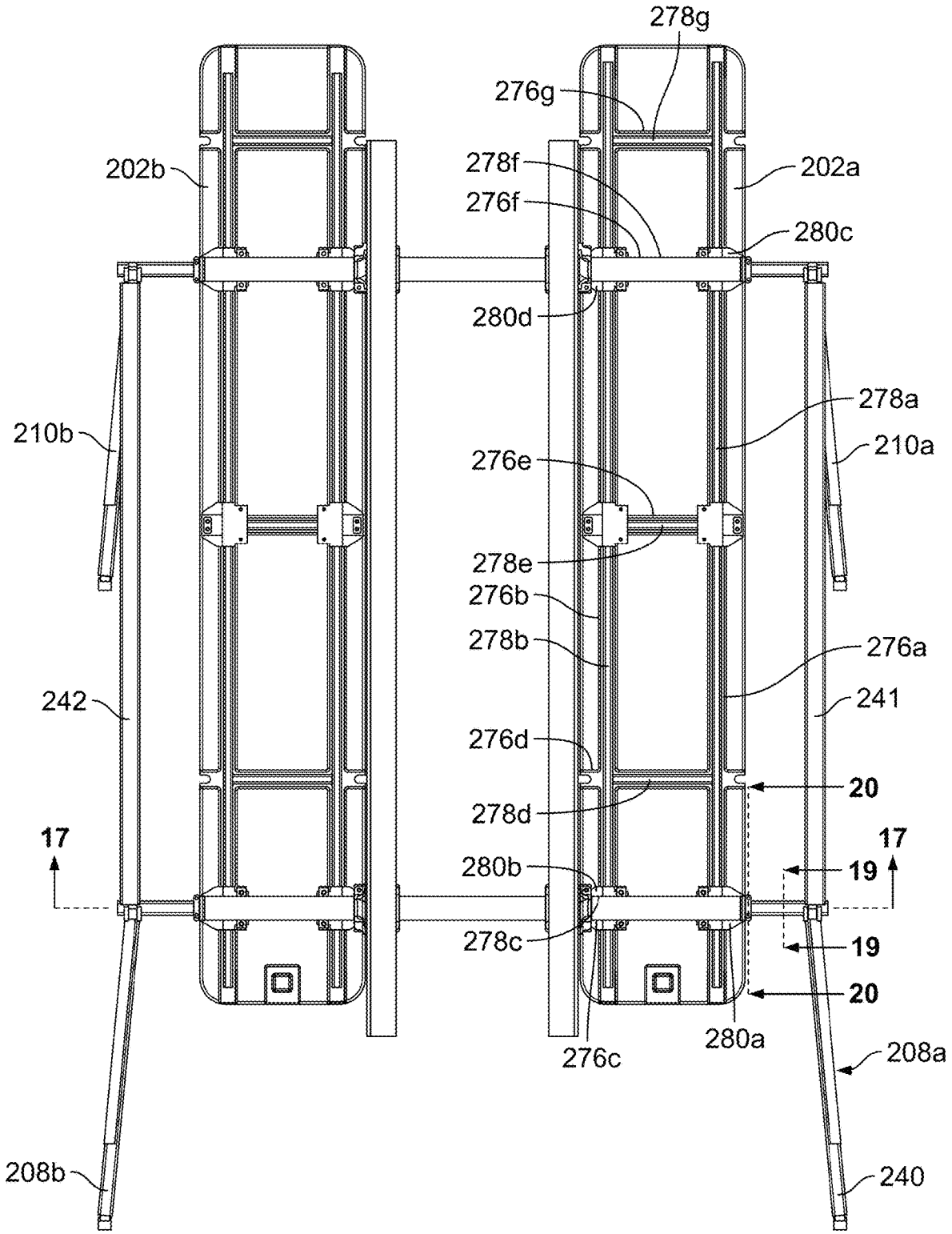
FIG. 12 is a top plan view of the boat lift of FIG. 11.
Figure 13:
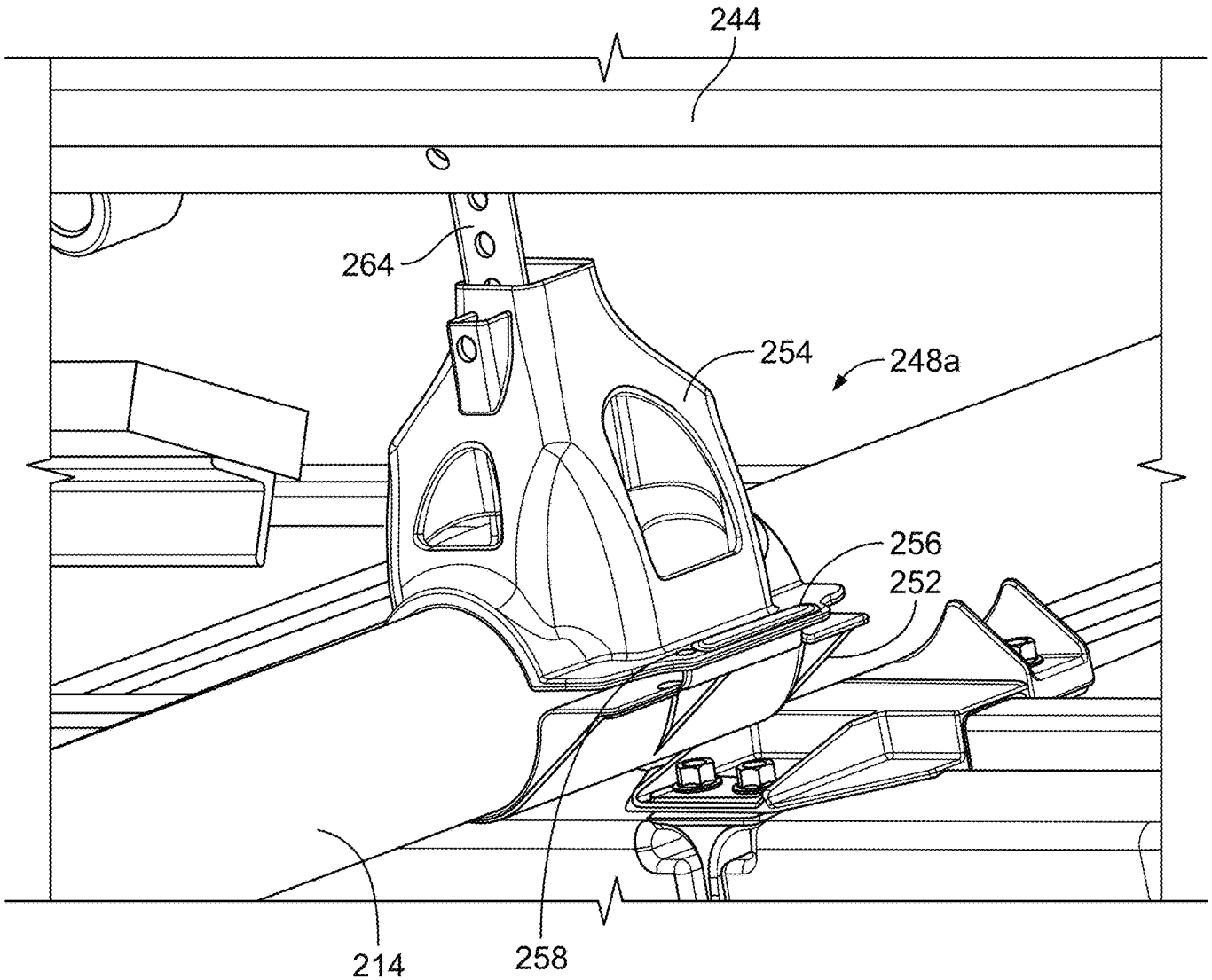
FIG. 13 is a perspective view of a support for mounting a bunk to a bunk support frame of the boat lift of FIG. 11.
Figure 14:
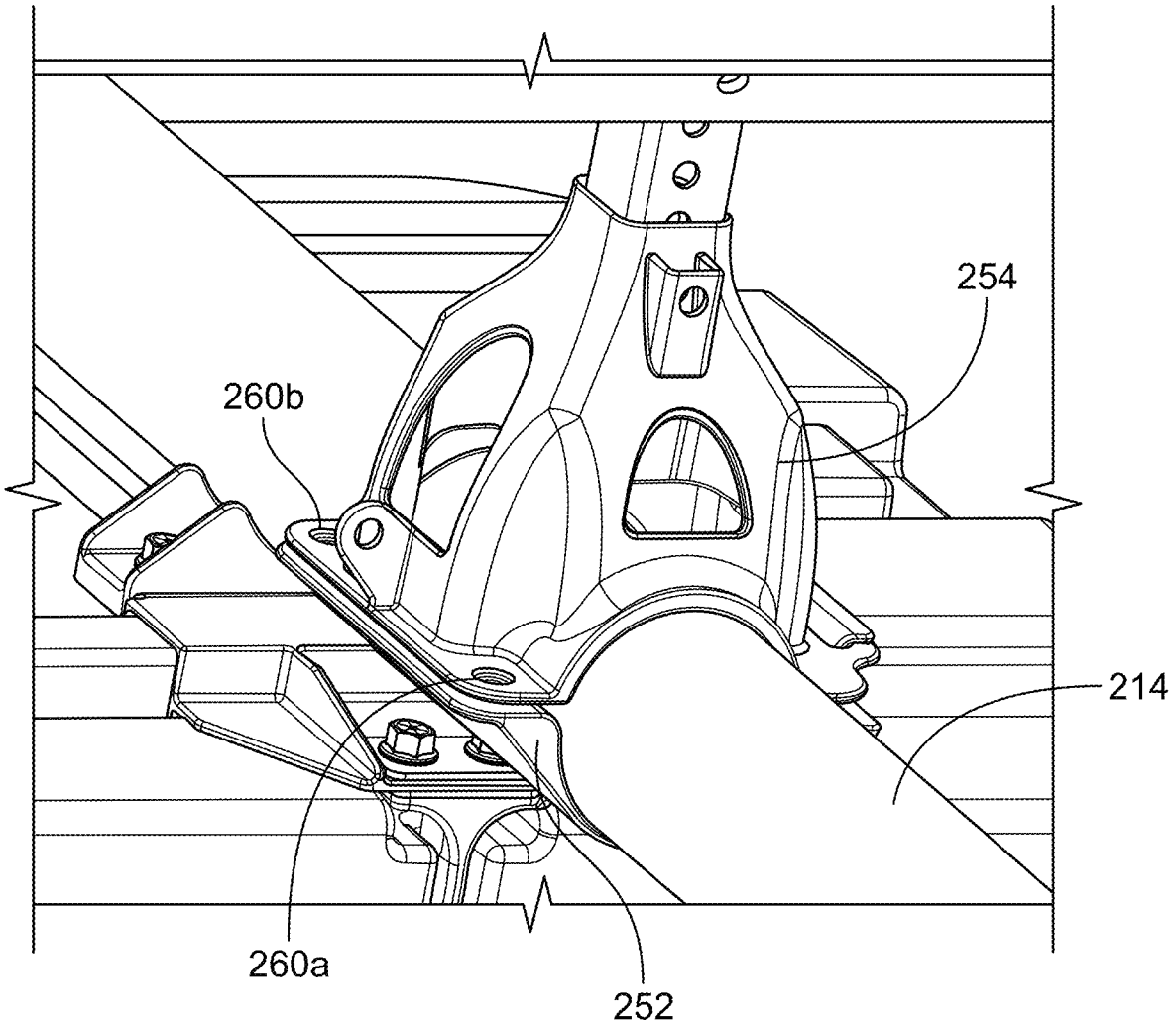
FIG. 14 is a perspective view of another side of the support shown in FIG. 13.

The arms 208*a-b* and 210*a-b* have a substantially similar structure. Accordingly, only arm 208*a* is described in detail herein with reference to FIG. 21. The arm 208*a* includes a first section 236 that is mounted to the torque bar 206 and that extends into the bunk support frame 204*a*. A second section 238 extends outward from the first section 236 and is approximately perpendicular to the first section 236. An end of the second section 238 is mounted to a stabilizer 241. A third section 240 of the arm 208*a* extends outward from the first section 236 at an obtuse angle directed laterally outward from the tank 202*a*, as best shown in FIG. 12. The third section 240 of the arm 208*a* is also generally perpendicular to the second section 238. An end of the third section 240 includes an opening that can receive a fastener to mount the arm 208*a* to a dock. A spherical bearing may be mounted in the opening for receiving the fastener. The other arms 208*b* and 210*a-b* may be mounted to the dock in a similar manner.

As shown in FIG. 12, the stabilizer 241 extends between arms 208*a* and 210*a*. The stabilizer 241 extends in a direction that is generally parallel to the tanks 202*a-b*. Another stabilizer 242 is mounted to arms 208*b* and 210*b* in a similar manner. The stabilizers 241 and 242 help to ensure that the boat lift 200 remains parallel to the upper surface of the dock to which it is mounted as the boat lift 200 is raised and lowered in the water.

As shown in FIG. 17, the first bunk assembly 212*a* includes a first bunk 244 and the second bunk assembly 212*b* includes a second bunk 246 that are each arranged at an angle with respect to a horizontal plane. The first bunk 244 and second bunk 246 are configured to support a boat with a V hull, but the boat lift 200 may include bunks for supporting any type of suitable watercraft. As shown in FIG.

11, the first bunk assembly 212*a* includes a first support 248*a* mounted to the bunk support frame 204*a* and a second support 248*b* mounted to the bunk support frame 204*b*. The first and second supports 248*a-b* extend upward from the bunk support frames 204*a-b* to space the bunk 244 above the bunk support frames 204*a-b* a suitable distance. The second bunk assembly 212*b* includes a third support 250*a* mounted to the bunk support frame 204*a* and a fourth support 250*b* mounted to the bunk support frame 204*b*. The third and fourth supports 250*a-b* extend upward from the bunk support frames 204*a-b* to space the bunk 246 above the bunk support frames 204*a-b* a suitable distance.

The first and second supports 248*a-b* and the third and fourth supports 250*a-b* are substantially similar. Accordingly, only first support 248*a* is described in detail herein with reference to FIGS. 13-16. The first support 248*a* includes first and second sections 252 and 254 that are removably joined to each other to clamp around the cylindrical tube 214 of the bunk support frame 204*a*. A first side of the first section 252 has a tab 256 that is receivable within a slot 258 of a first side of the second section 254. Alternatively, the tab may be on the second section 254 with the slot on the first section 252. A second side of the first section 252 comprises a pair of openings 260*a-b* (FIG. 14) that align with a pair of openings 262*a-b* (FIG. 15) in a second side of the second section 254 when the support 248*a* is mounted to the bunk support frame 204*a*. The aligned openings 260*a-b*, 262*a-b* are configured for receiving fasteners (not shown) to join the first section 252 to the second section 254. When the support 248*a* is mounted on the cylindrical tube 214, the first section 252 extends around the bottom half of the tube 214, and the second section 254 extends around the top half of the tube 214. A mount 264 (FIG. 13) adjustably fastened to the top half of the second section 254 mounts the bunk 244 to the support 248*a*. The mount 264 can be raised and lowered with respect to the second section 254 in order to raise and lower the position of the bunk 244.

Figure 15:
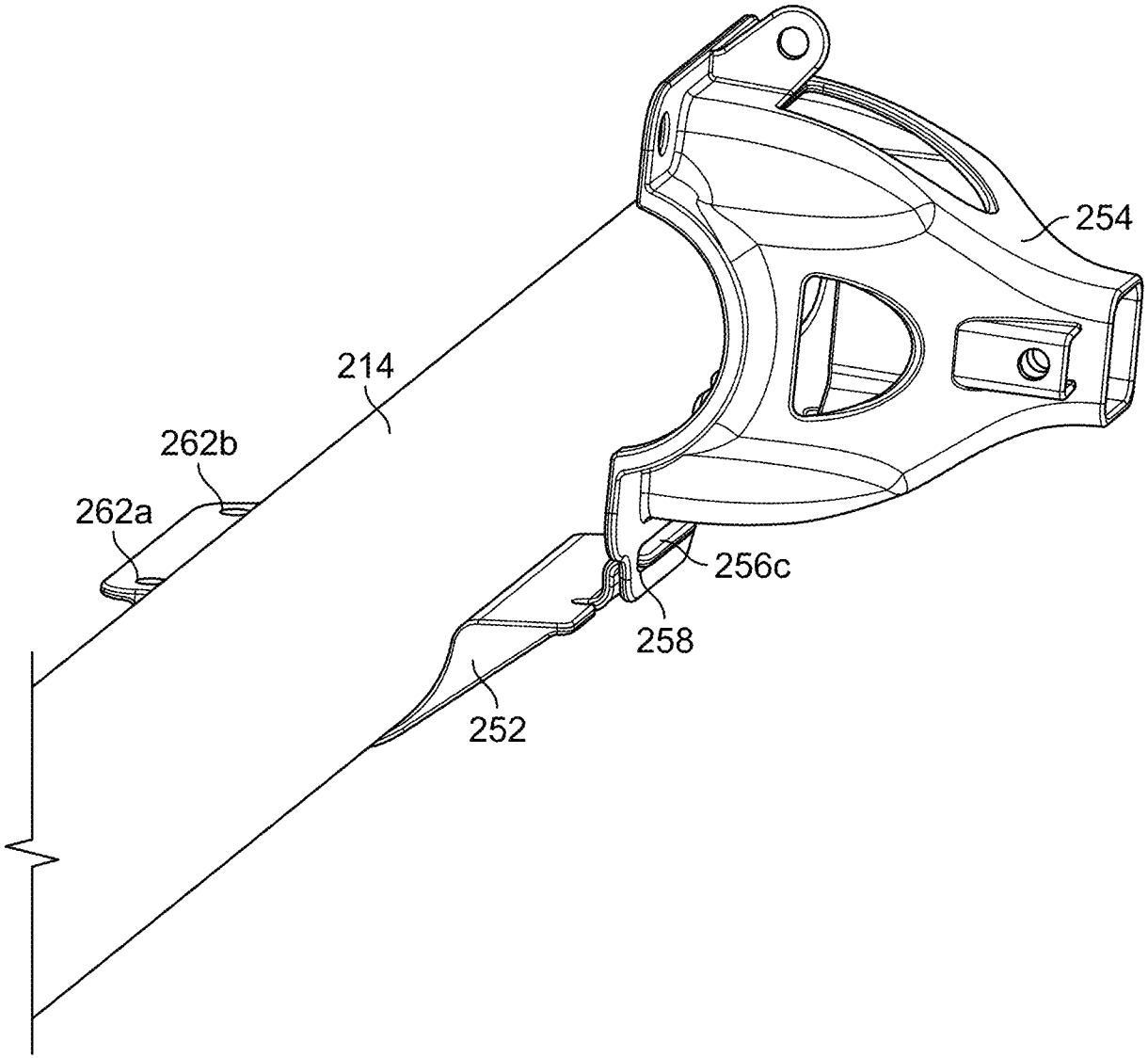
FIG. 15 is a perspective view of the support shown in FIG. 13 in a partially installed position.
Figure 16:
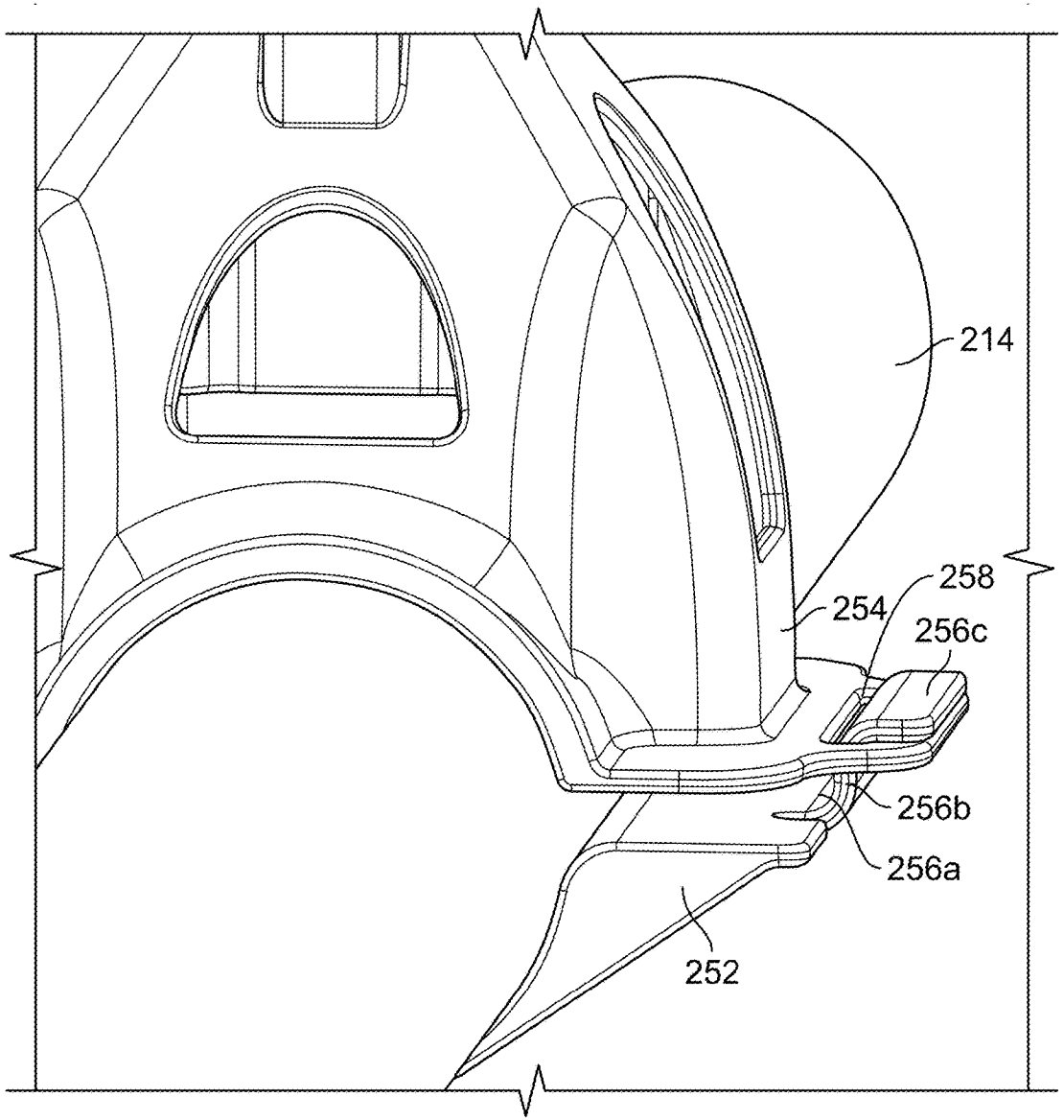
FIG. 16 is a perspective view of a tab and slot of the support shown in FIG. 13.

Referring to FIG. 16, the tab 256 on the first section 252 is generally formed in an S-shape with a first horizontal section 256*a* extending laterally outward from a base of the first section 252, a vertical section 256*b* extending upward from the first horizontal section 256*a*, and a second horizontal section 256*c* extending laterally outward from the vertical section 256*b*. As shown in FIG. 15, the second section 254 can be installed on the first section 252 by first inserting the second horizontal section 256*c* of the tab 256 through the slot 258. The second section 254 is then rotated 90 degrees to the position shown in FIG. 16 until the vertical section 256*b* is received by the slot 258. In this position, the second horizontal section 256*c* is positioned above a portion of the second section 254 to prevent the second section 254 from moving vertically upward relative to the first section 252. When the second section 254 is in this position, fasteners can be inserted through the aligned openings 260*a-b* (FIG. 14) and 262*a-b* (FIG. 15) to securely fasten and clamp the support 248*a* to the bunk support frame 204*a*.

The tanks 202*a-b* are substantially similar. Accordingly, only tank 202*a* is described in detail herein. As shown in FIG. 11, the tank 202*a* includes an upper surface 266, side walls 268*a-b* extending downward from the upper surface 266, a front wall 270 and a rear wall 272 each extending downward from the upper surface 266, and a bottom surface 274. Referring to FIG. 12, recesses 276*a-g* extending across the upper surface 266 receive a tank frame 278. The tank frame 278 includes frame members 278*a-g* each received by one of the recesses 276*a-g*. The frame members 278*a-g* are further joined to each other. The frame members 278*a-g* may be tubes with rectangular or square cross-sections. Four clamp assemblies 280*a-d* mount the tank frame 278 to the upper surface 266 of the tank 202*a*. The clamp assemblies 280*a-d* are generally positioned adjacent corners of the tank 202*a* at the upper surface 266.

Figure 22:
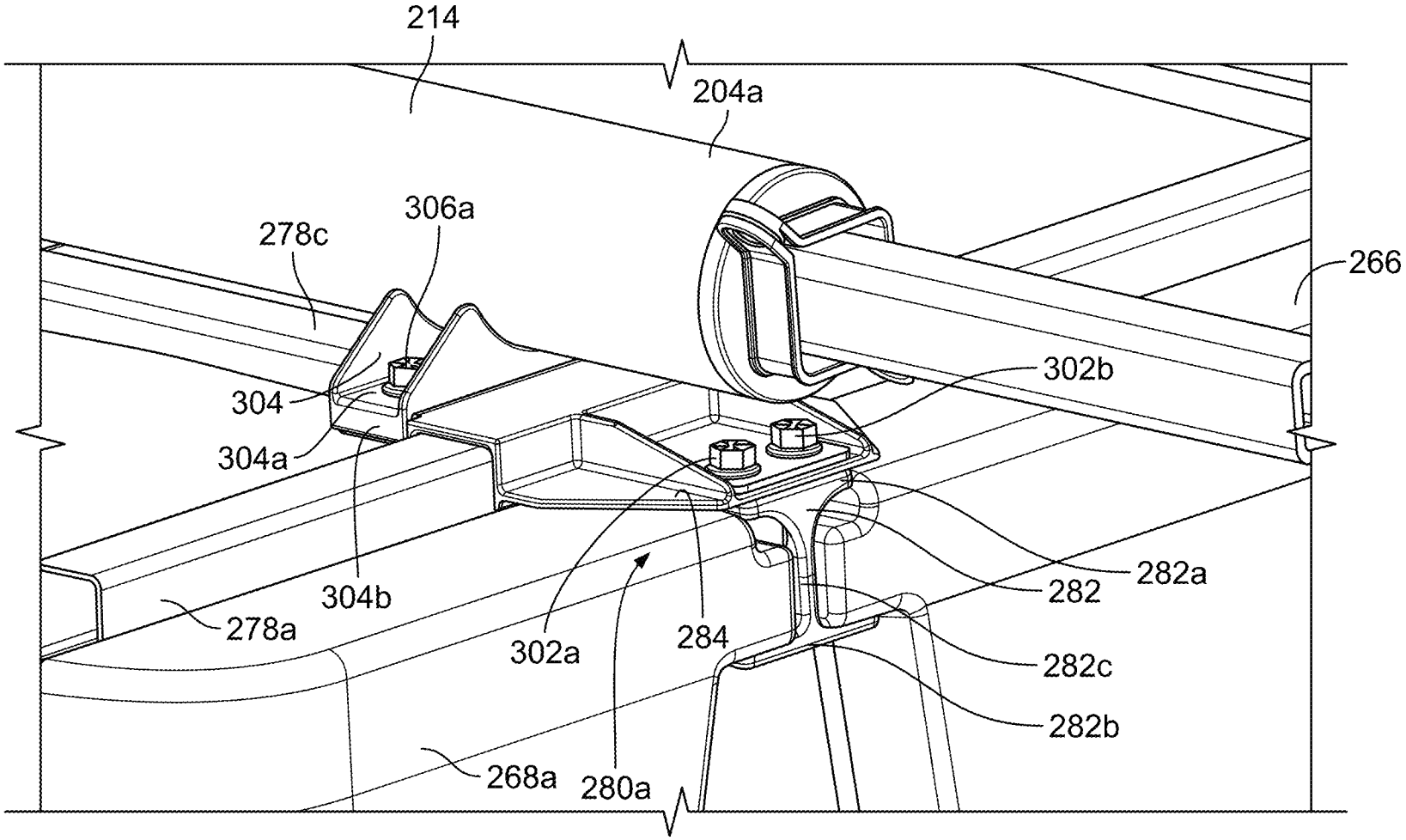
FIG. 22 is a perspective view of a clamp assembly for mounting a tank frame and bunk support frame to a tank of the boat lift of FIG. 11.
Figure 23:
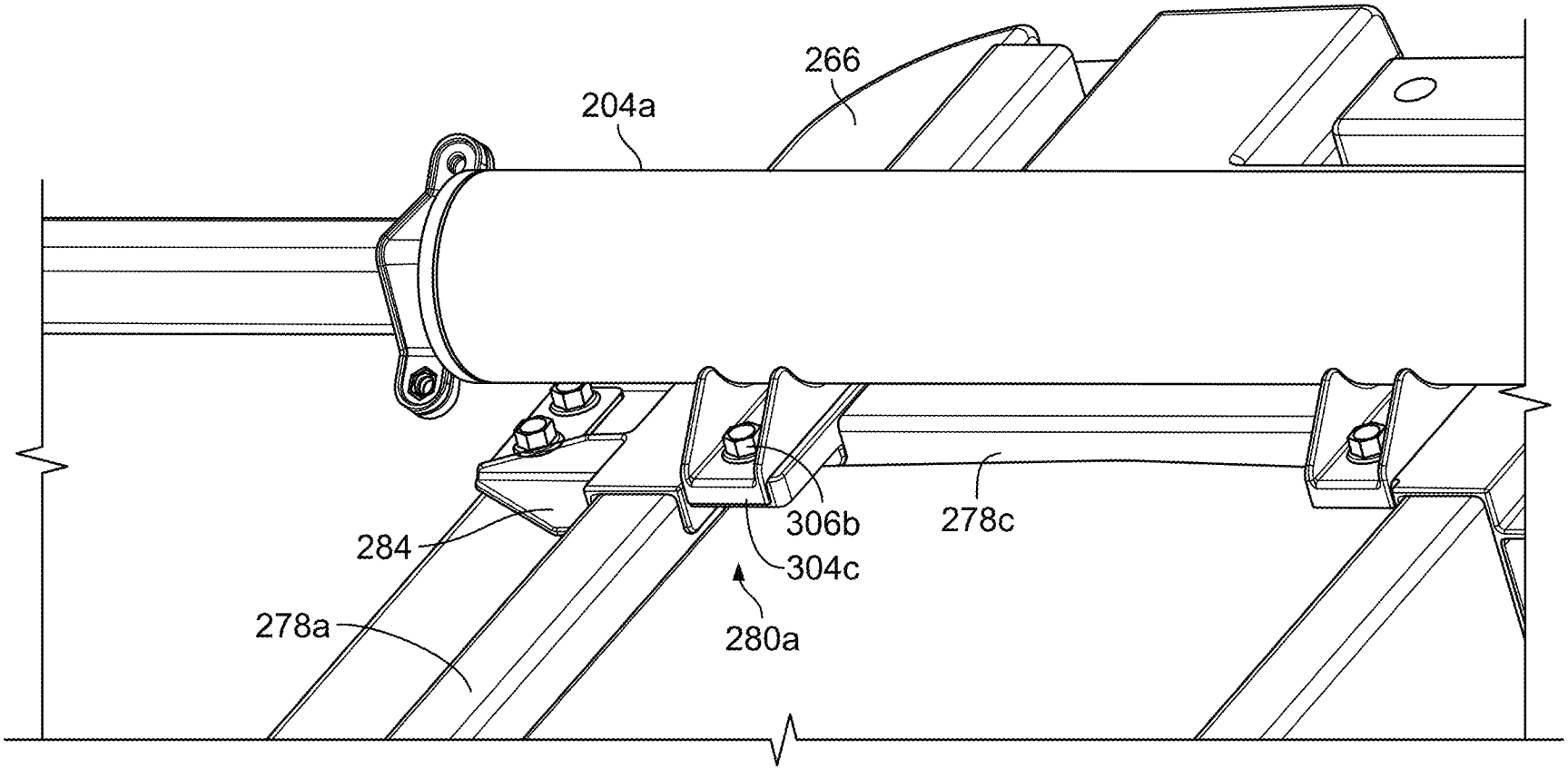
FIG. 23 is a perspective view of another side of the clamp assembly shown in FIG. 22.
Figure 24:
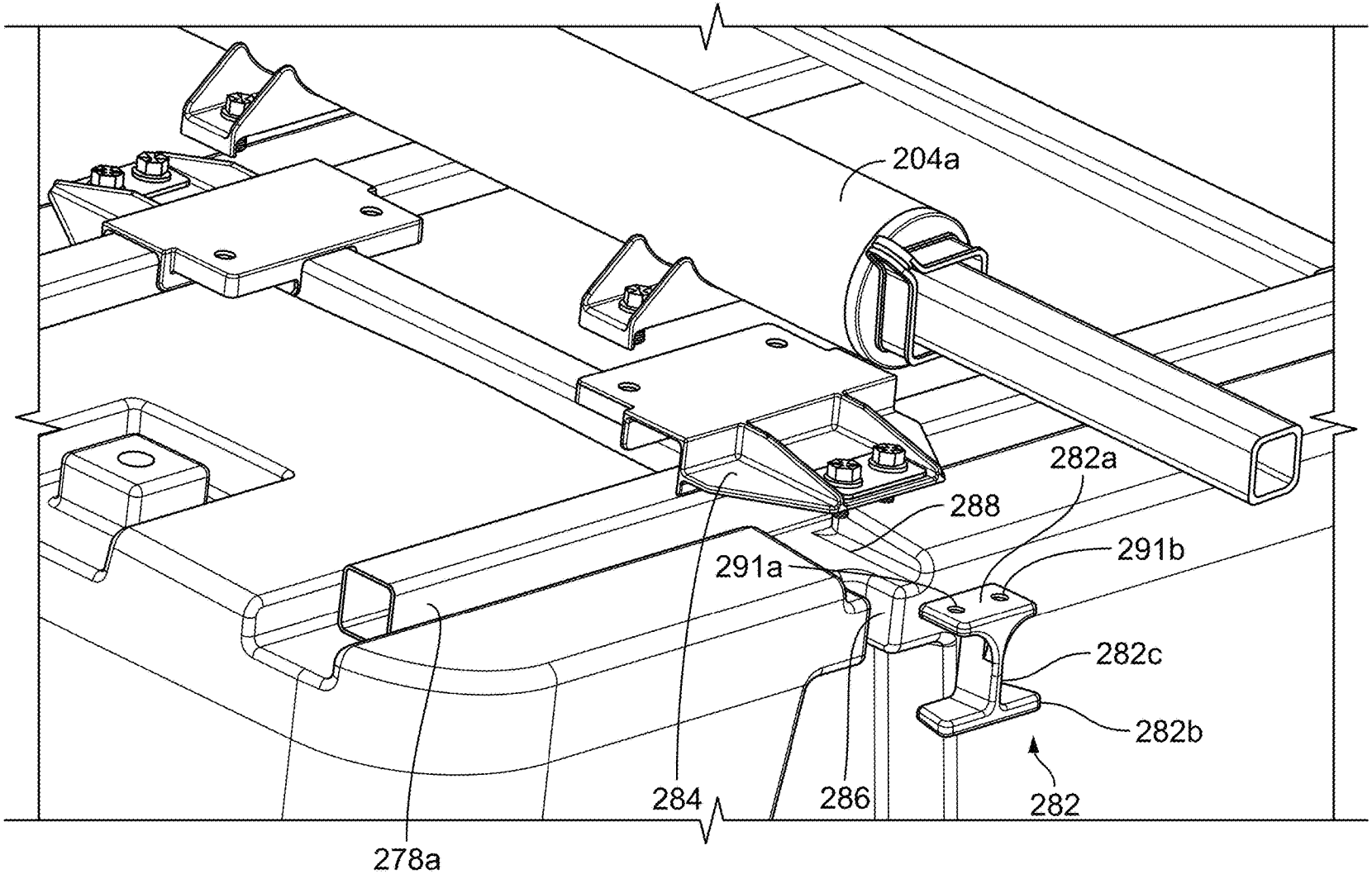
FIG. 24 is a partially exploded view of the clamp assembly shown in FIG. 22.
Figure 27:
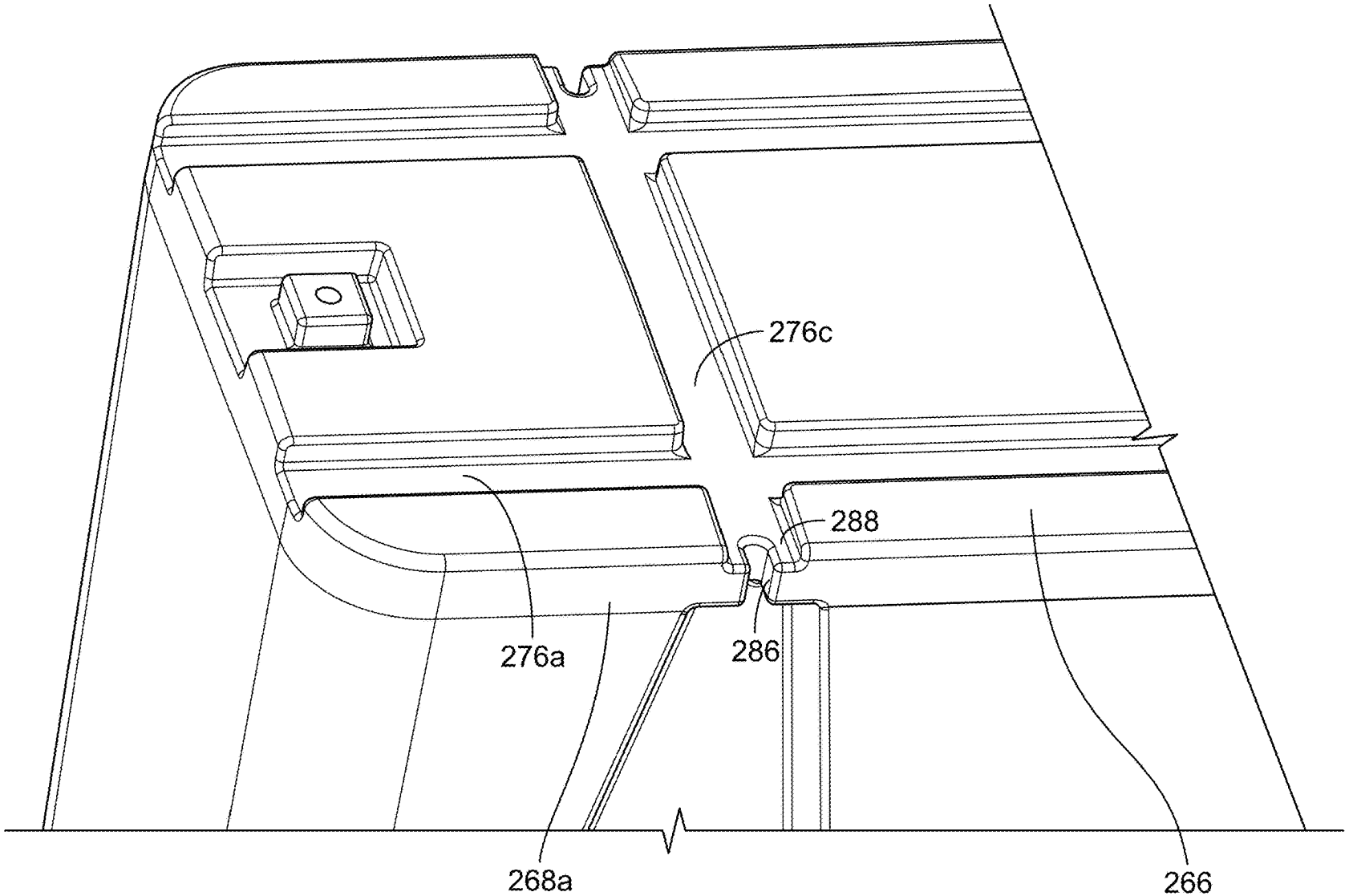
FIG. 27 is a perspective view of a portion of the tank of the boat lift shown in FIG. 11.
Figure 28:
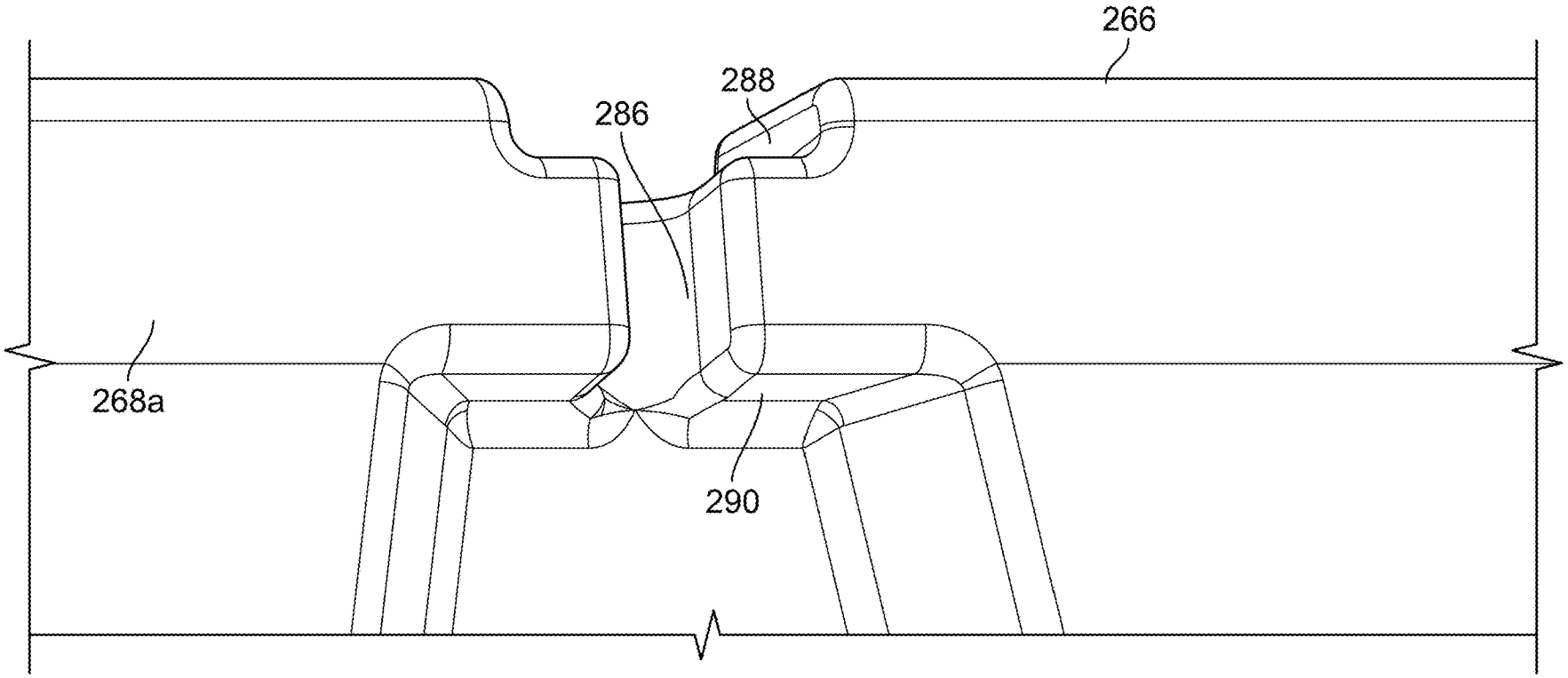
FIG. 28 is a perspective view of a slot and pocket of the tank shown in FIG. 27.

The clamp assemblies 280*a-d* are substantially similar. Accordingly, only clamp assembly 280*a* is described in detail herein. As shown in FIGS. 22-24, clamp assembly 280*a* includes a first section 282 and a second section 284 mounted to the first section 282. As shown in FIG. 24, the first section 282 has a cross section that is generally I-shaped with top and bottom horizontal flanges 282*a-b* and a vertical base 282*c* connecting the flanges. The first section 282 is configured for insertion into a slot 286 and a pocket 288 of the tank 202*a*. As shown in FIG. 27, the pocket 288 is formed as a portion of the recess 276*c* in the upper surface 266 of the tank 202*a*. The pocket 288 is adjacent the side wall 268*a*. The slot 286 is formed in the side wall 268*a* of the tank 202*a*. As shown in FIG. 28, the tank 202*a* has a clamping surface 290 that extends from the side wall 268*a* back toward a center of the tank 202*a*. The slot 286 is accessible from the pocket 288 at the upper surface 266 and the clamping surface 290. As shown in FIG. 22, the first section 282 of the clamp assembly 280*a* is insertable into the pocket 288 and slot 286 in a manner such that the vertical base 282*c* extends through the slot 286, the top flange 282*a* is positioned in the pocket 288 adjacent the upper surface 266 of the tank 202*a*, and the bottom flange 282*b* is positioned adjacent the clamping surface 290 (FIG. 28). As shown in FIG. 24, threaded openings 291*a-b* extend through the top flange 282*a*.

Figure 25:
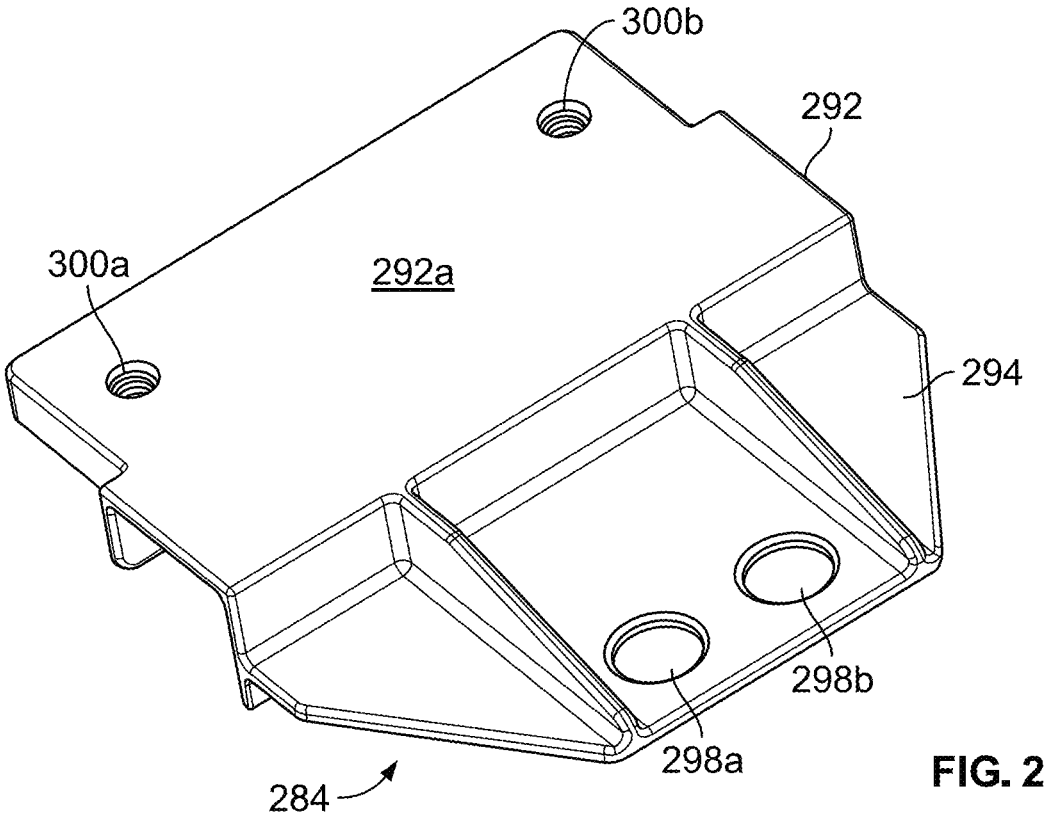
FIG. 25 is a perspective view of a second section of the clamp assembly shown in FIG. 22.
Figure 26:
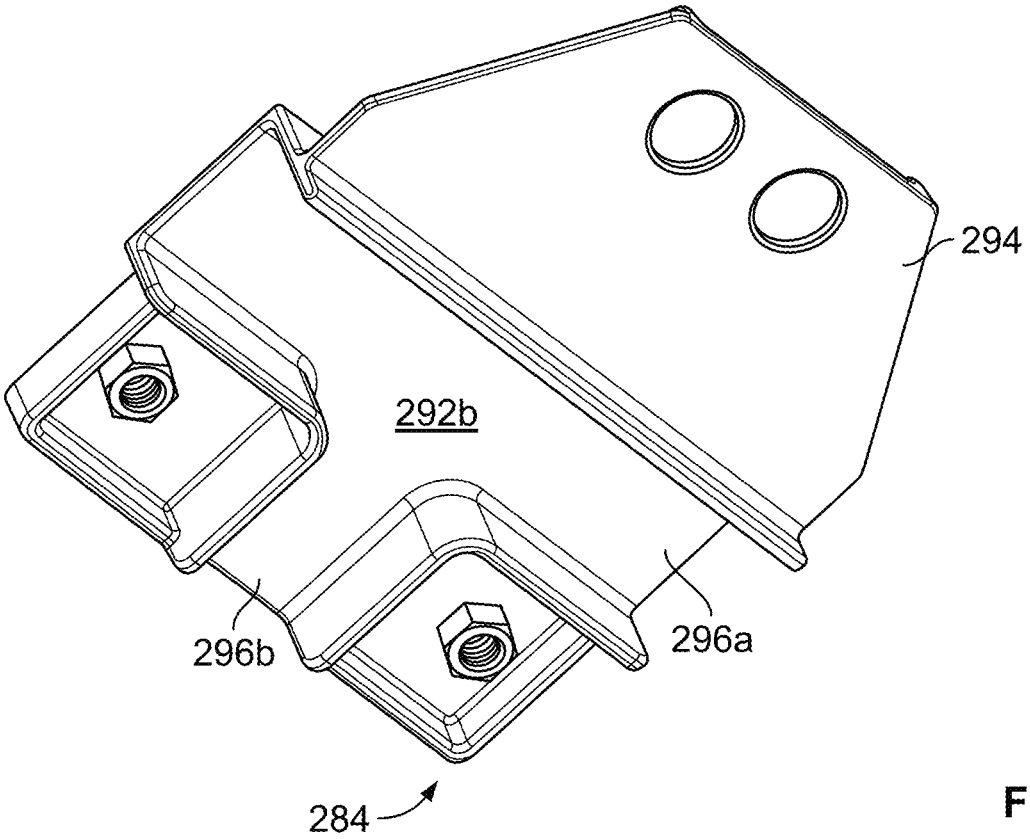
FIG. 26 is a perspective view of a bottom of the second section of the clamp assembly shown in FIG. 25.

Referring to FIGS. 25 and 26, the second section 284 of the clamp assembly 280*a* has a base 292 with a flange 294 extending outward from the base 292. The base 292 has a top 292*a* and a bottom 292*b*. Intersecting channels 296*a-b* are formed in the bottom 292*b* of the base 292. The flange 294 includes openings 298*a-b*, and the base 292 includes threaded openings 300*a-b*.

As shown in FIG. 22, to clamp the tank frame 278 to the tank 202*a*, the second section 284 is positioned above the first section 282 and the upper surface 266 of the tank 202*a*. The frame member 278*a* is received within the channel 296*a* of the second section 284, and the frame member 278*c* is received within the channel 296*b*. The openings 291*a-b* and 298*a-b* of the first and second sections 282 and 284 are aligned, and screws 302*a-b* are threaded into engagement with the first section 282 to join the first and second sections 282, 284. As the screws 302*a-b* are tightened, the bottom flange 282*b* of the first section 282 engages the clamping surface 290 of the tank 202*a*, and the bottom 292*b* of the second section 284 engages the frame members 278*a* and 278*c* clamping them to the tank 202*a*. When the frame members 278*a* and 278*c* are received within the channels 296*a-b* of the second section 284, the second section 284 cannot move laterally in a horizontal plane aligned with the upper surface 266 of the tank 202*a*. The channels 296*a-b* may assist a user assembling the boat lift 200 in correctly positioning the second section 284 on top of the first section 282 for clamping the tank frame 278 to the tank 202*a*.

The bunk support frame 204*a* also mounts to the second section 284 of the clamp assembly 280*a*. The bunk support frame 204*a* has a mount 304 fixed to an underside of the cylindrical tube 214. The mount 304 has a base 304*a* that engages the base 292 of the second section 284. The mount 304 has a tab 304*b* (FIG. 22) and a tab 304*c* (FIG. 23) extending downward from opposite sides of the base 292. The tabs 304*b-c* engage sides of the base 292 to locate the mount 304 on the base and align openings of the mount 304 with the openings 300*a-b* (FIG. 25) of the second section 284. When the tabs 304*b-c* engage the sides of the base 292, the mount 304 cannot slide horizontally in a direction aligned with the direction of extension of the frame member 278*a*. Further, the mount 304 cannot slide horizontally outward in a direction aligned with the direction of extension of the frame member 278*c*, as best shown in FIG. 23. Fasteners 306*a-b* extend through the aligned openings to mount the bunk support frame 204*a* to the second section 284 of the clamp assembly 280*a*. The bunk support frame 204*a* has another mount that mounts to the clamp assembly 280*b* shown in FIG. 12 and two additional mounts that mount to clamp assemblies mounted to tank 202*b*. The bunk support frame 204*b* mounts to tanks 202*a-b* in a similar manner.

In operation, the boat lift 200 may be operated in a similar manner as the boat lift 10 described above to raise and lower a boat.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A boat lift comprising:

at least one tube configured to receive air;

a bunk support frame coupled to the tube, the bunk support frame defining a channel accessible through a first opening at one end of the bunk support frame and a second opening at an opposite end of the bunk support frame;

a torque bar extending through the channel from the first opening to the second opening, the torque bar supported by the bunk support frame and operable to rotate with respect to the bunk support frame;

a pair of arms mounted to opposite ends of the torque bar, the arms configured for mounting to a dock; and a bunk coupled to the bunk support frame and configured to support a boat.

2. The boat lift of claim 1, wherein the bunk support frame further comprises first and second support bushings that are at least partially received by the first and second openings, respectively, the torque bar extending through and supported by the first and second support bushings.

3. The boat lift of claim 2, wherein the pair of arms define a second channel that receives the torque bar, wherein at least a portion of each of the arms is received within the channel, and wherein each of the arms is positioned between the torque bar and one of the first or second support bushings.

4. The boat lift of claim 3, wherein each of the arms is mounted to the torque bar with at least one set screw.

5. The boat lift of claim 1, wherein the torque bar comprises end surfaces each positioned at one of the opposite ends, each end surface defining at least one threaded opening, and wherein each of the arms is mounted to the torque bar with at least one fastener that extends through an opening in the arm and engages the threaded opening of one of the end surfaces.

6. The boat lift of claim 5, wherein each of the arms defines a receptacle that receives one of the ends of the torque bar.

7. The boat lift of claim 1, wherein each of the arms comprises a first section and a second section that is adjustably coupled to the first section, the first section mounted to one of the ends of the torque bar, and the second section configured for mounting to the dock.

8. The boat lift of claim 7, wherein the second section comprises a first end that is mounted to the first section and a second end that is configured for mounting to the dock, wherein the second section is adjustably coupled to the first section so that the second end is adjustable in a direction that is generally aligned with a longitudinal axis of the torque bar.

9. The boat lift of claim 8, wherein the second section defines a slot positioned between the first end and the second end, wherein a fastener extends through the slot and at least one opening of the first section.

10. The boat lift of claim 8, wherein the second end of the second section has a spherical bearing configured to receive a fastener for mounting the second section to the dock.

11. The boat lift of claim 1, further comprising:

a second bunk support frame coupled to the tube, the second bunk support frame defining a second channel accessible through a third opening at one end of the second bunk support frame and a fourth opening at an opposite end of the second bunk support frame, wherein the bunk is coupled to the second bunk support frame;

a second torque bar extending through the second channel from the third opening to the fourth opening, the second torque bar supported by the second bunk support frame and operable to rotate with respect to the second bunk support frame;

a second pair of arms mounted to opposite ends of the second torque bar, the second pair of arms configured for mounting to the dock; and first and second stabilizers each mounted to one of the pair of arms and one of the second pair of arms.

12. The boat lift of claim 1, wherein the bunk support frame encloses a portion of the torque bar that is positioned within the channel.

13. A boat lift comprising:

at least one tube configured to receive air;

a bunk support frame coupled to the tube;

a bunk coupled to the bunk support frame and configured to support a boat;

a torque bar supported by the bunk support frame and operable to rotate with respect to the bunk support frame; and a pair of arms mounted to opposite ends of the torque bar, wherein each of the arms comprises a first end mounted to the torque bar and a second end configured for mounting to a dock, wherein the second end of at least one of the arms is adjustable with respect to the first end in a direction that is generally aligned with a longitudinal axis of the torque bar.

14. The boat lift of claim 13, wherein each of the arms comprises a first section and a second section that is adjustably coupled to the first section, the first section mounted to one of the ends of the torque bar, and the second section configured for mounting to the dock.

15. The boat lift of claim 14, wherein the second section includes the second end of the arm that is configured for mounting to the dock, wherein the second section is adjustably coupled to the first section so that the second end is adjustable in the direction that is aligned with a longitudinal axis of the torque bar.

16. The boat lift of claim 15, wherein the second section defines a slot positioned between the first end and the second end, wherein a fastener extends through the slot and at least one opening of the first section.

17. The boat lift of claim 15, wherein the second end of the second section has a spherical bearing configured to receive a fastener for mounting the second section to the dock.

* * * * *